US007372445B2

(12) United States Patent
Takahashi et al.

(10) Patent No.: US 7,372,445 B2
(45) Date of Patent: May 13, 2008

(54) DRIVING DEVICE OF DISPLAY DEVICE, DISPLAY DEVICE, AND DRIVING METHOD OF DISPLAY DEVICE

(75) Inventors: Shinya Takahashi, Funabashi (JP); Hajime Washio, Sakurai (JP); Yuhichiroh Murakami, Matsusaka (JP); Seijirou Gyouten, Matsusaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 602 days.

(21) Appl. No.: 11/080,849

(22) Filed: Mar. 16, 2005

(65) Prior Publication Data

US 2005/0206637 A1 Sep. 22, 2005

(30) Foreign Application Priority Data

Mar. 17, 2004 (JP) ..... 2004-077272

(51) Int. Cl.
*G09G 3/36* (2006.01)

(52) U.S. Cl. ..... 345/100; 345/204

(58) Field of Classification Search ..... 345/87–100, 345/204; 382/162
See application file for complete search history.

(56) References Cited

U.S. PATENT DOCUMENTS 5,867,141 A 2/1999 Asada et al.
6,208,325 B1 * 3/2001 Reddy et al. ..... 345/658
7,068,253 B2 * 6/2006 Kudo et al. ..... 345/99
7,239,742 B2 * 7/2007 Ohtani et al. ..... 382/162
2002/0126107 A1 * 9/2002 Inoue et al. ..... 345/204
2002/0135556 A1 * 9/2002 Nakajima et al. ..... 345/98
2002/0175887 A1 * 11/2002 Yamazaki ..... 345/87
2002/0196241 A1 12/2002 Morita
2003/0122773 A1 7/2003 Washio et al.

(Continued)

FOREIGN PATENT DOCUMENTS

JP 8-271859 A 10/1996

(Continued)

*Primary Examiner*—Nitin I. Patel
(74) *Attorney, Agent, or Firm*—Harness, Dickey & Pierce, P.L.C.

(57) ABSTRACT

A driving device of a display device includes: a data signal line driving circuit, provided with a shift register having a level shifter for boosting a source clock signal so as to apply the source clock signal to a flip-flop, which causes a sampling circuit to directly sample a multi-gradation data signal based on each output from the shift register so as to output the multi-gradation data signal to each of a plurality of data signal lines; a control circuit for switching a full-screen display mode in which a whole of the display screen performs display and a partial-screen display mode in which only a part of the display screen performs time-sharing display; a data generating section for generating a constant voltage data writing signal made of a constant voltage; and a control circuit for outputting a selection signal for causing a nondisplay portion to directly sample the constant voltage data writing signal from the constant voltage data writing signal generation means so as to output the constant voltage data writing signal to a plurality of data signal lines. This makes it possible to provide a driving device of a display device, a display device, and a driving method of a display device, all of which make it possible to reduce power consumption in a waiting state.

16 Claims, 15 Drawing Sheets

U.S. PATENT DOCUMENTS

2004/0027364 A1* 2/2004 Ohtani et al. ..... 345/699
2004/0085275 A1* 5/2004 Sugiyama et al. ..... 345/87

FOREIGN PATENT DOCUMENTS

JP 2003-248468 A 9/2003
TW 580825 B 3/2004
WO WO 93/06585 4/1993

* cited by examiner

DRIVING DEVICE OF DISPLAY DEVICE, DISPLAY DEVICE, AND DRIVING METHOD OF DISPLAY DEVICE

This Nonprovisional application claims priority under 35 U.S.C. § 119(a) on Patent Application No. 077272/2004 filed in Japan on Mar. 17, 2004, the entire contents of which are hereby incorporated by reference.

FIELD OF THE INVENTION

The present invention relates to a driving device of a display device such as a liquid crystal display device, a display device, and a driving method of a display device. The present invention can be used for an active-matrix liquid crystal display device, a driving method of a liquid crystal display device, and a liquid crystal display device. Particularly, the present invention can be applied to a mobile information tool such as a mobile phone and a PDA.

BACKGROUND OF THE INVENTION

Recently, a liquid crystal display device used in a mobile device has been required to less consume power as the mobile device has been required to operate for an extended period of time. Here, for example, a mobile device such as a mobile phone is not always in a busy state but is in a waiting state for most of the time. Further, an image and a format displayed in a busy state are usually different from those displayed in a waiting state.

For example, in a waiting state, a liquid crystal display device only needs to be able to display a menu screen, time, and the like and therefore may occasionally have low fineness and a small number of display colors. Rather, it is important for a liquid crystal display device to less consume power so as to operate for an extended period of time. Conversely, in a busy state, a liquid crystal display device usually displays a large quantity of sentences, figures, and images such as pictures and therefore is required to perform high-definition display. At this time, other parts (e.g., a communication module, an input interface section, and an operation processing section) of a mobile device consume a large amount of electric power, so that a display module less consumes power. Therefore, a mobile device is more strongly required to less consume power in a waiting state than in a busy state.

Accordingly, for example, in an attempt to reduce power consumption in a waiting state, Japanese Laid-Open Publication 248468/2003 (Tokukai 2003-248468; published on Sep. 5, 2003) discloses an image display device 100. In the image display device 100, as shown in FIG. 15, a display screen 101 is divided for display, i.e., partial display. In the partial display mode, the display screen is divided into three areas P1, P2, and P3. For example, the areas P1 and P3 serve as nondisplay portions each of which displays nothing but a white background, and the area P2 displays a static image such as time and wallpaper. Therefore, in a waiting state, the area P2 serves as a display portion, and the areas P1 and P3 serve as nondisplay portions. And, in a waiting state, the area P2 and the areas P1 and P3 are driven for display at different refresh rates (rewrite rates). The areas P1 and P3 are driven for display at a lower refresh rate for intermittent writing than the area P2.

This causes the image display device 100 in a busy state to perform high-definition display of a large quantity of sentences, figures, and images such as pictures in a multi-gradation manner and causes the areas P1 and P3 in a waiting state to perform display by more intermittent writing than the area P2 in a waiting state, thereby reducing power consumption.

A driving method of the image display device 100 will be described more in detail based on a timing chart. Note that, a timing chart in a case where partial display is not performed will be described first.

First, as shown in FIG. 16, in a full-screen display mode in which partial display is not performed, a gate start pulse GSP becomes high in voltage for every predetermined number of gate clock signals GCK. That is, the gate start pulse GSP becomes high in voltage in every single vertical scanning period (1V). At this time, in a data signal line driving circuit, a source start pulse SSP becomes high in voltage for every predetermined number of source clock signals SCK, so that a data signal DAT is applied to a pixel after preliminary charging with a pre-charge control signal PCTL. Therefore, in this driving method, the gate clock signals GCK and the source clock signals SCK continually operate, and a refresh rate of a display screen 201 is constant. Further, display is performed in every single vertical scanning period. This undesirably incurs an increase in power consumption.

Conversely, as shown in FIG. 17, in a driving mode in which partial display is performed, the areas P1 and P3 serve as nondisplay portions each of which displays nothing but a white background (white data). Moreover, a refresh rate of the white data can be lowered without raising any display problem. This causes the refresh rate to be lower than that of image data for display in the area P2.

Further, the area P2 performs display once in every three vertical scanning periods (3V). That is, the gate clock signals GCK and the gate start pulse GSP, as well as the source clock signals SCK and the source start pulse SSP, are activated in a first vertical scanning period, and the gate clock signals GCK and the gate start pulse GSP, as well as the source clock signals SCK and the source start pulse SSP, are stopped in a second scanning period and a third scanning period so as to stop circuit operation. A liquid crystal is prone to retain display even when thus driven, so that a static image keeps being displayed.

Furthermore, the white data for nondisplay is displayed in every six scanning periods, and a driving circuit thereof is stopped in a fourth scanning period, thereby further reducing power consumption.

Thus, in the display device of the laid-open publication discloses various techniques for reducing power consumption.

However, as shown in FIG. 17, in the conventional driving method of a conventional liquid crystal display device, the white data for nondisplay on a background in the areas P1 and P3, in a waiting state, is displayed at a low refresh rate but is written by using multi-gradation display data.

Here, when the multi-gradation display data is used, a data signal line driving circuit needs to be driven. The data signal line driving circuit has a shift register, a latch circuit, and a level shifter. The level shifter raises such a problem that an invalid current constantly flows regardless of operations.

Therefore, the arrangement raises such a problem that power is consumed unless the data signal line driving circuit is stopped.

SUMMARY OF THE INVENTION

It is an object of the present invention to provide a driving device of a display device, a display device, and a driving method of a display device, all of which make it possible to reduce power consumption in a waiting state.

In order to solve the foregoing problems, a driving device of a display device according to the present invention is a driving device for driving a display device provided with a display screen, having a plurality of scanning signal lines and a plurality of data signal lines crossing each other, in which an image display data signal is outputted to a pixel provided at each of crossings through each of the data signal lines in synchronism with a scanning signal outputted from each of the scanning signal lines, said driving device includes:

a data signal line driving circuit including a shift register which has (i) multiple stages of flip-flops each of which operates in synchronism with a source clock signal and (ii) a level shifter for boosting the source clock signal whose amplitude is smaller than a driving voltage of each of the flip-flops so as to apply the driving voltage to the flip-flop, said data signal line driving circuit causing a sampling circuit to sample the image display data signal based on an output from the shift register so as to output the image display data signal to the data signal line;

mode switching means for switching a full-screen display mode in which a whole of the display screen performs display and a partial-screen display mode in which only a part of the display screen performs time-sharing display from each other;

constant voltage data writing signal generation means for generating a constant voltage data writing signal made of a constant voltage; and constant voltage data selection means for causing a nondisplay portion, except for that part of the display screen which performs the time-sharing display in the partial-screen display mode, to directly sample the constant voltage data writing signal from the constant voltage data writing signal generation means so as to output the constant voltage data writing signal to the data signal line.

Further, in order to solve the foregoing problems, a driving method of a display device according to the present invention is a method for driving a display device provided with a display screen, having a plurality of scanning signal lines and a plurality of data signal lines crossing each other, in which an image display data signal is outputted to a pixel provided at each of crossings through each of the data signal lines in synchronism with a scanning signal outputted from each of the scanning signal lines, said driving device including a data signal line driving circuit having a shift register which has (i) multiple stages of flip-flops each of which operates in synchronism with a source clock signal and (ii) a level shifter for boosting the source clock signal whose amplitude is smaller than a driving voltage of each of the flip-flops so as to apply the driving voltage to the flip-flop, said data signal line driving circuit causing a sampling circuit to sample the image display data signal based on an output from the shift register so as to output the image display data signal to the data signal line, said method comprising the steps of:

switching a full-screen display mode in which a whole of the display screen performs display and a partial-screen display mode in which only a part of the display screen performs time-sharing display from each other;

generating a constant voltage data writing signal made of a constant voltage; and causing a nondisplay portion, except for that part of the display screen which performs the time-sharing display in the partial-screen display mode, to directly sample the constant voltage data writing signal from the constant voltage data writing signal generation means so as to output the constant voltage data writing signal to the data signal line.

According to the foregoing invention, the driving device of a display device includes a data signal line driving circuit having a shift register which has (i) multiple stages of flip-flops each of which operates in synchronism with a source clock signal and (ii) a level shifter for boosting the source clock signal whose amplitude is smaller than a driving voltage of each of the flip-flops so as to apply the driving voltage to the flip-flop, and the data signal line driving circuit causing a sampling circuit to sample the image display data signal based on an output from the shift register so as to output the image display data signal to the data signal line.

Therefore, when the driving device of a display deice is driven, an invalid current of a transistor of the level shifter constantly flows, so that power is consumed even when a data signal is not outputted to the data signal line.

Meanwhile, according to the present invention, a full-screen display mode in which a whole of a display screen performs display and a partial-screen display mode in which only a part of the display screen performs display are switched over. Therefore, the partial display mode is adopted in the present invention.

Here, the partial display mode, used for example in a display device of a mobile device such as a mobile phone, is a mode in which an image is partially displayed in a waiting state. And, since a waiting state occupies a longer period of time, there is particularly a need for reducing power consumption.

Accordingly, in the present invention, there are provided: constant voltage data writing signal generation means for generating a constant voltage data writing signal made of a constant voltage in a single horizontal scanning period (1H) or a single vertical scanning period (1V); and constant voltage data selection means for causing a nondisplay portion, except for that part of the display screen which performs time-sharing display in the partial-screen display mode, to directly sample a constant voltage data writing signal from the constant voltage data writing signal generation means so as to output the constant voltage data writing signal to the data signal line.

Therefore, the constant voltage data selection means causes a nondisplay portion in the partial-screen display mode to directly sample the constant voltage data writing signal from the constant voltage data writing signal generation means so as to output the constant voltage data writing signal to the data signal line.

As a result, the nondisplay portion in the partial-screen display mode is made to send an output to the data signal line without passing through the shift register having the level shifter, so that there is no need for driving the level shifter. This prevents an invalid current of a transistor in the level shifter from constantly flowing, thereby reducing power consumption.

Therefore, it is possible to provide a driving device of a display device and a driving method of a display device, both of which make it possible to reduce power consumption in a waiting state.

Further, a display device of the present invention includes the driving device and therefore can provide a display device which makes it possible to reduce power consumption in a waiting state.

For a fuller understanding of the nature and advantages of the invention, reference should be made to the ensuing detailed description taken in conjunction with the accompanying drawings.

BRIEF DESCRIPTION OF THE DRAWINGS

FIG. 5(*b*) is a timing chart showing an operation of the reset-set flip-flop.

DESCRIPTION OF THE EMBODIMENTS

One embodiment of the present invention will be described below with reference to FIGS. 1 to 14.

Figure 2:
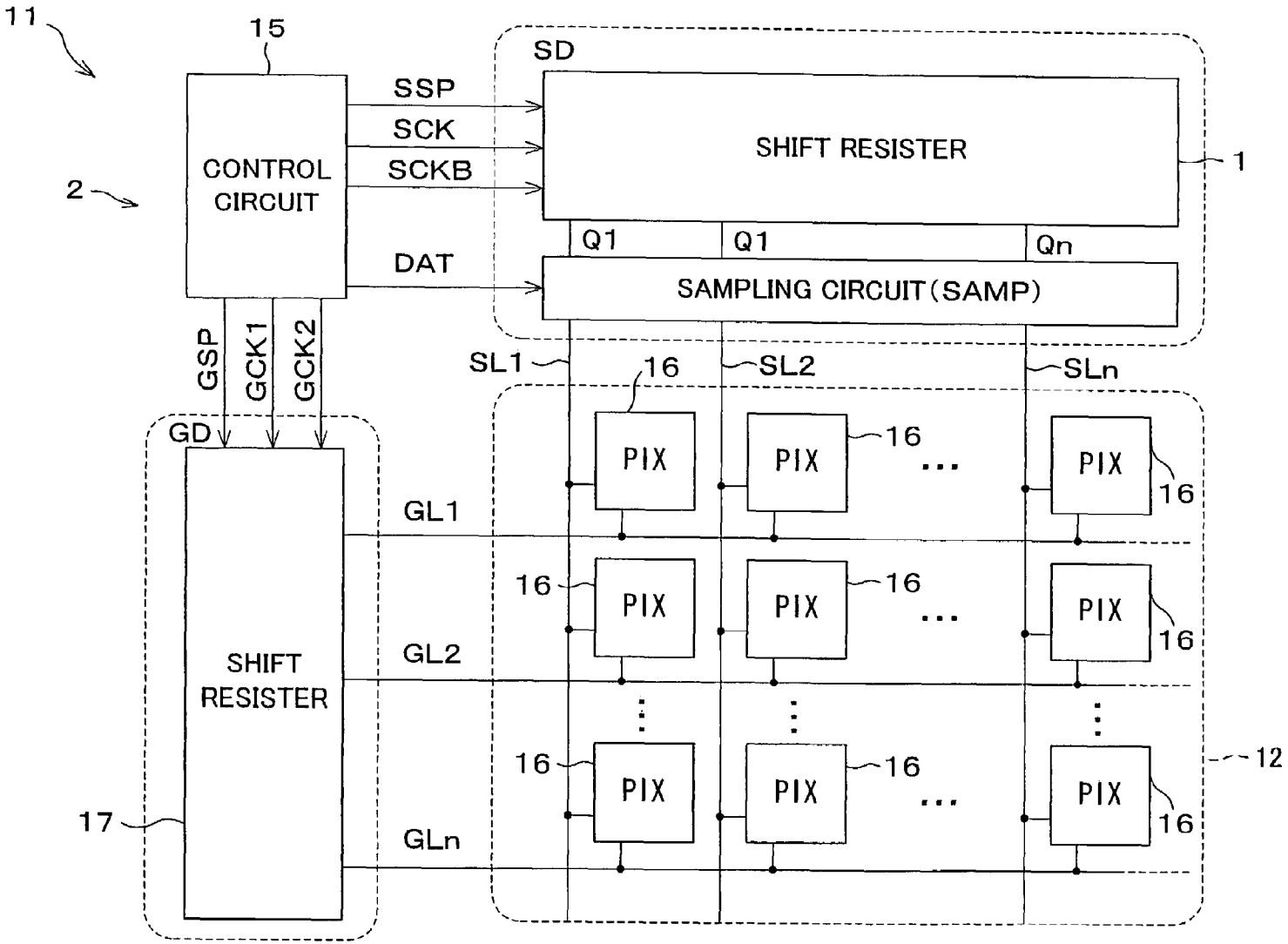
FIG. 2 is a block diagram showing an arrangement of the liquid crystal display device.

As shown in FIG. 2, a liquid crystal display device 11, serving as a display device of the present embodiment, has a display screen 12, a scanning signal line driving circuit GD, a data signal line driving circuit SD, and a control circuit 15 serving as control means. The scanning signal line driving circuit GD, the data signal line driving circuit SD, and the control circuit 15 constitute a driving device 2.

The display screen 12 has n number of scanning signal lines . . . GL (GL1, GL2, . . . GLn) parallel to one another, n number of data signal lines . . . SL (SL1, SL2, . . . SLn) parallel to one another, and pixels (PIX in the figure) 16 arranged in a matrix manner. Each of the pixels 16 is formed in an area surrounded by two scanning signal lines GL adjacent to each other and two data signal lines SL adjacent to each other. Note that, the number of scanning signal lines GL and the number of data signal lines SL are equally n for the purpose of convenience in description, but the numbers may be different from each other.

The scanning signal line driving circuit GD has a shift register 17. The shift register 17 is arranged so as to serially generate scanning signals which are supplied to scanning signal lines GL1, GL2, . . . connected to the pixels 16 in respective lines based on two types of gate clock signals GCK1 and GCK2 and a gate start pulse GSP inputted from the control circuit 15. Note that, a circuit arrangement of the shift register 17 will be described later.

The data signal line driving circuit SD has a shift register 1 and a sampling circuit SAMP. Two types of source clock signals SCK and SCKB whose phases are different from each other and a source start pulse SSP are inputted from the control circuit 15 into the shift register 1, and a multi-gradation data signal DAT, i.e., an image display data signal serving as a video signal is inputted from the control circuit 15 into the sampling circuit SAMP. The inverse source clock signal SCKB is an inverse signal of the source clock signal SCK.

The data signal line driving circuit SD is arranged so as to cause the sampling circuit SAMP to sample the multi-gradation data signal DAT based on output signals Q1 to Qn outputted from respective stages of the shift register 1, thereby outputting thus obtained video data to data signal lines SL1, SL2, . . . connected to the pixels 16 in respective rows.

The control circuit 15 is a circuit which generates various control signals for controlling operation of the scanning signal line driving circuit GD and the data signal line driving circuit SD. As described above, clock signals GCK1, GCK2, SCK, and SCKB, start pulses GSP and SSP, a multi-gradation data signal DAT, and the like are prepared to serve as control signals.

Note that, the scanning signal line driving circuit GD of the liquid crystal display device 11, the data signal line driving circuit SD, and the pixels 16 of the display screen 12 are respectively provided with switch elements.

Figure 3:
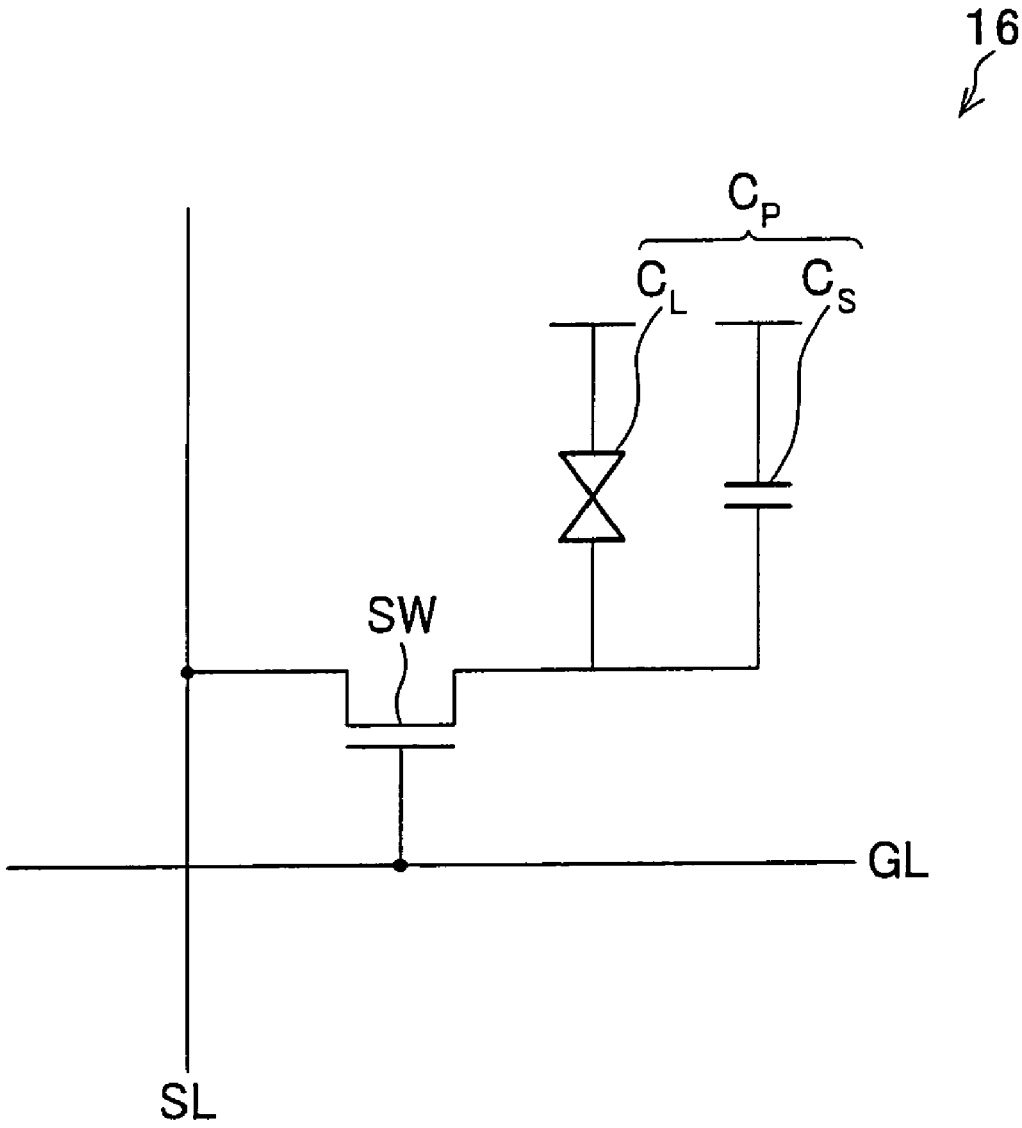
FIG. 3 is a block diagram showing an arrangement of a pixel in the liquid crystal display device.

When the liquid crystal display device 11 is an active-matrix liquid crystal display device, the pixel 16, as shown in FIG. 3, is constituted of a pixel transistor SW serving as a switch element made of a filed-effect transistor and a pixel capacitor CP (to which an auxiliary capacitor is added if necessary) including a liquid crystal capacitor CL. In such a pixel 16, a data signal line SL is connected to an electrode on one side of the pixel capacitor CP through a drain and a source of the pixel transistor SW, and a gate of the pixel transistor SW is connected to a scanning signal line GL, and one electrode on the other side of the pixel capacitor CP is connected to a common electrode line (not shown) which is shared by all pixels.

Here, a pixel 16 connected to an i-th data signal line SLi and a j-th scanning signal line GLj is represented by PIX (i, j) (i is such an integer as 1≦i and j is such an integer as j≧n). Then, in the PIX (i, j), when the scanning signal line GLj is selected, the pixel transistor SW becomes conductive, and a voltage serving as video data applied to the data signal line SLi is applied to the pixel capacitor CP. When the voltage is thus applied to the liquid capacitor CL in the pixel capacitor CP, a transmittance or a reflectance of a liquid crystal is modulated. Therefore, when the scanning signal line GLj is selected and a signal voltage according to video data is applied to the data signal line SLi, a display mode of the PIX (i, j) can be changed in accordance with the video data.

In the liquid crystal display device 11, the scanning signal line driving circuit GD selects a scanning line signal GL, and video data to a pixel 16 corresponding to a combination of the scanning signal line GL being selected and a data signal line SL is outputted to each data signal line SL by the data signal line driving circuit SD. This allows the video data to be written in the pixel 16 connected to the scanning signal line GL. Moreover, the scanning signal line driving circuit GD sequentially selects scanning signal lines GL, and the data signal line driving circuit SD outputs the video data to data signal lines SL. As a result, the video data is written in all the pixels 16 of the display screen 12, so that an image in accordance with a multi-gradation data signal DAT is displayed on the display screen 12.

Here, in an interval from the control circuit 15 to the data signal line driving circuit SD, video data to each pixel 16 is transmitted as a multi-gradation data signal DAT in a time-sharing manner, and the data signal line driving circuit SD extracts video data from the multi-gradation data signal DAT at a timing based on: a source clock signal SCK, serving as a timing signal, whose duty ratio is 50% or less at a predetermined cycle (in the present embodiment, a low period is shorter than a high period); an inverse source clock signal SCKB, whose phase is different by 180° from that of the source clock signal SCK; and a source start pulse SSP.

Specifically, the shift register 1 of the data signal line driving circuit SD sequentially outputs in a shifting manner a pulse corresponding to a half clock cycle when a source start pulse SSP is inputted in synchronism with a source clock signal SCK and an inverse source clock signal SCKB, thereby generating output signals Q1 to Qn different from each other by one clock in terms of a timing. Further, the sampling circuit SAMP of the data signal line driving circuit SD extracts video data from a multi-gradation data signal DAT at timings of the respective output signals Q1 to Qn.

Meanwhile, the shift register 17 of the scanning signal line driving circuit GD sequentially outputs in a shifting manner a pulse corresponding to a half clock cycle when a gate start pulse GSP is inputted in synchronism with gate clock signals GCK1 and GCK2, thereby outputting scanning signals, different from each other by one clock in terms of a timing, to the respective scanning signal line GL1 to GLn.

Figure 17:
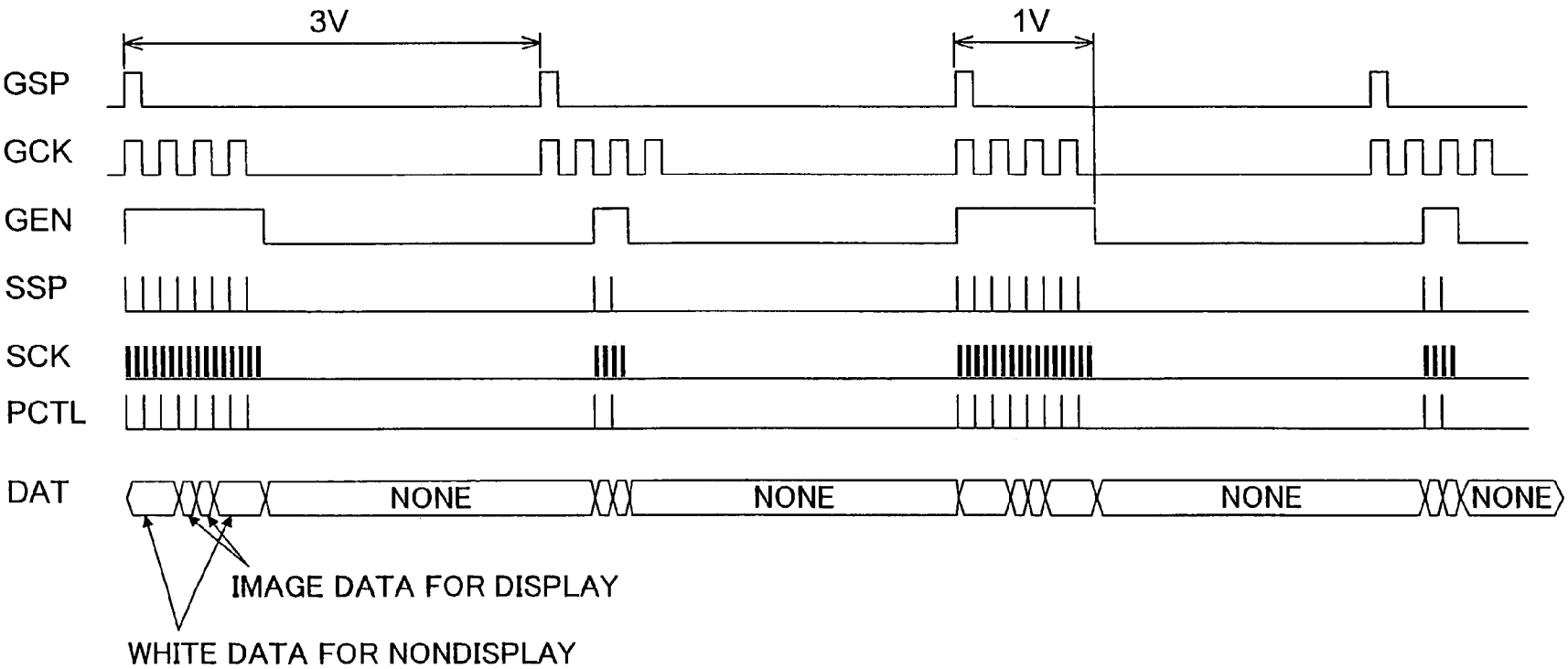
FIG. 17 is a timing chart showing waveforms of input-output signals in a full-screen display mode of another conventional liquid crystal display device.

Both an outline arrangement of the shift register 1 of the data signal line driving circuit SD and that of the shift register 17 of the scanning signal line driving circuit GD can be the same as a conventional arrangement shown in FIG. 17. However, a reset-set flip-flop used in the shift register 1 or 17 of the present embodiment is arranged differently from the conventional arrangement, so that a concrete example of the reset-set flip-flop will be described in detail below.

Figure 4:
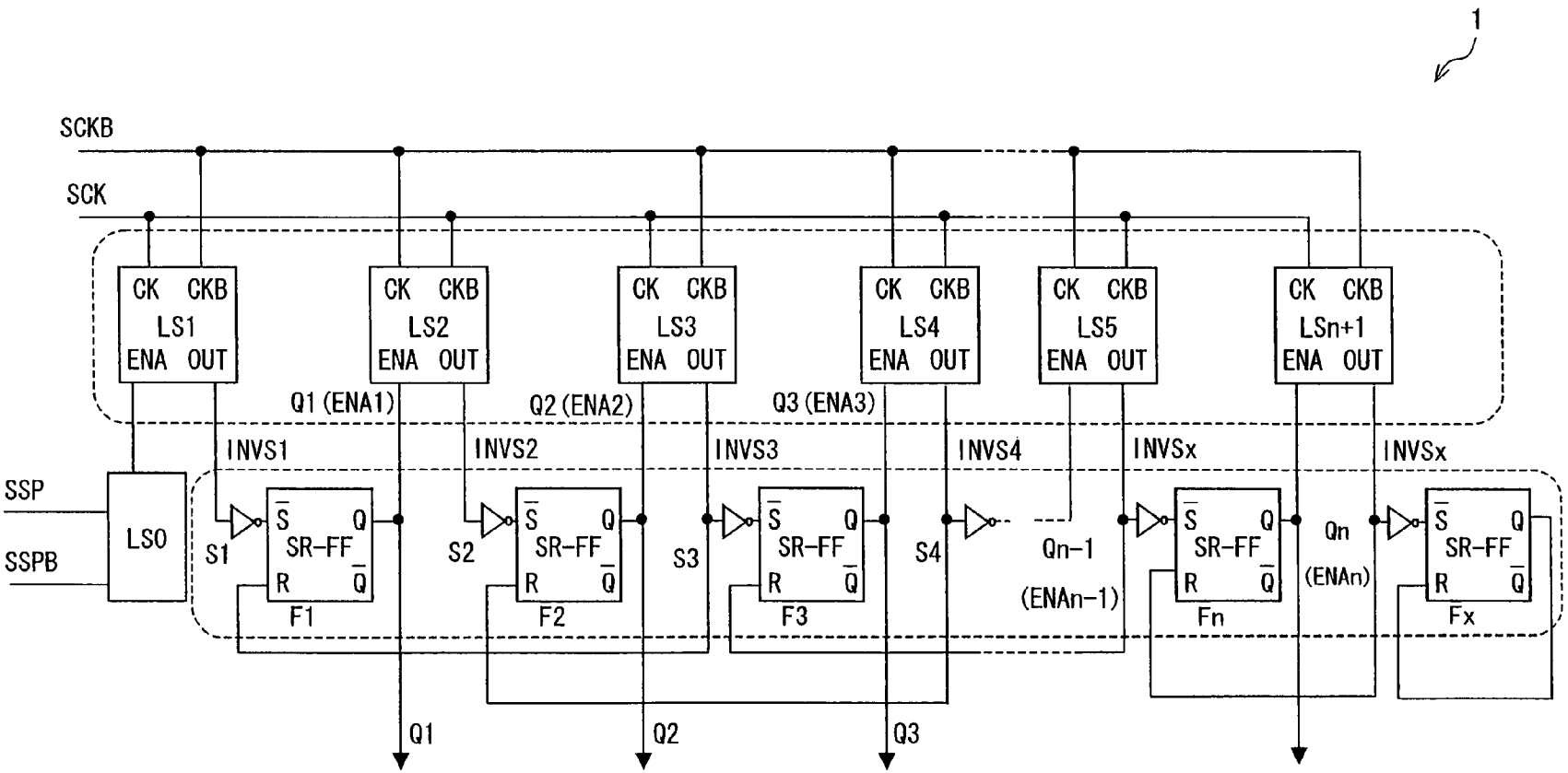
FIG. 4 is a block diagram showing an internal arrangement of a shift register of a data signal line driving circuit in the liquid crystal display device.

As shown in FIG. 4, the shift register 1 of the data signal line driving circuit SD of the present embodiment is constituted of reset-set flip-flops (SR-FF) (hereinafter referred to as "RS flip-flops") connected in a multistage manner. Further, also in the present embodiment, as is conventional, the shift register 1 of the data signal line driving circuit SD has a level shifter LS for shifting a level of a source clock signal SCK and that of an inverse source clock signal SCKB. Therefore, the level shifter LS is arranged so that: a 3.3V source clock signal SCK and an inverse source clock signal SCKB that are inputted therein cause output signals Q1, Q2, and Q3 made of an 8V drive voltage to be outputted through an individual shift register SR as a timing signal for causing video data to be outputted to a data signal line SL. Note that, the level shifter LS includes: clock level shifters LS1 to LSn+1, into which a source clock signal SCK or an inverse source clock signal SCKB is inputted; and a source start signal level shifter LS0, into which a source start signal SSP or an inverse source start signal SSPB is inputted.

One example of an arrangement of an RS flip-flop constituting the shift register 1 will be described with reference to FIGS. 5(*a*) and 5(*b*). Note that, as shown in FIG. 6, an RS flip-flop described below has terminals respectively corresponding to a set signal barred-S, a reset signal R, an output signal Q, and its inverse output signal barred-Q.

Figure 5:
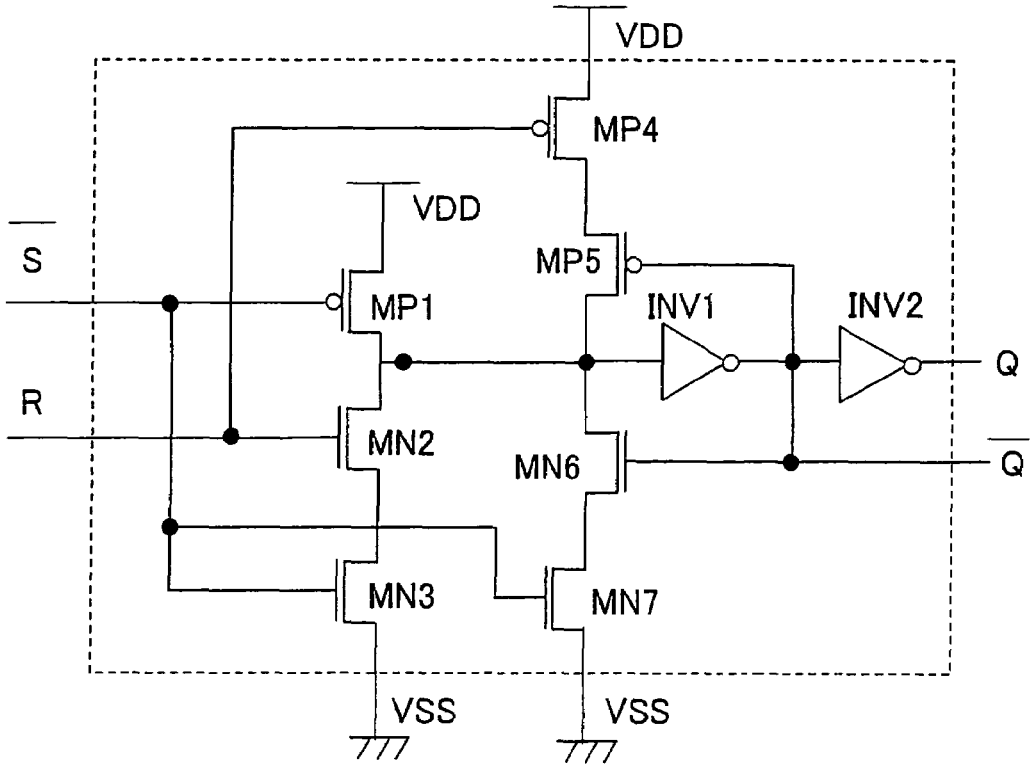
FIG. 5(*a*) is a block diagram showing a basic structure of a reset-set flip-flop in the shift register of the data signal line driving circuit.
Figure 5:
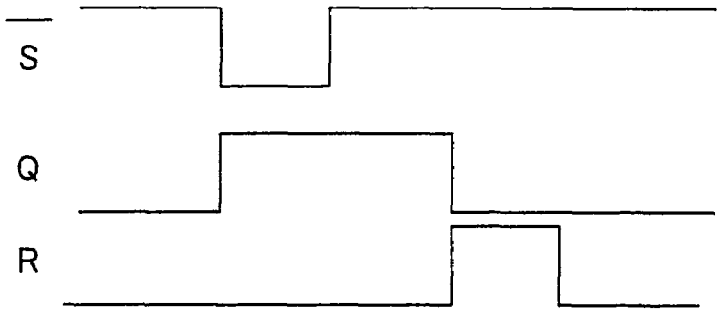
Figure 6:
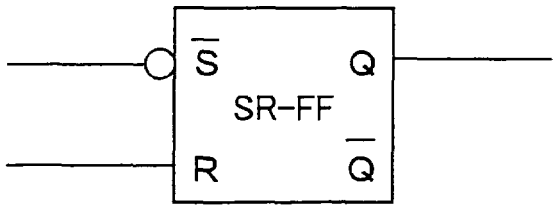
FIG. 6 is a diagram showing a basic structure of the reset-set flip-flop in the shift register of the data signal line driving circuit.

In the RS flip-flop, as shown in FIG. 5(*a*), a p-channel transistor MP1 and n-channel transistors MN2 and MN3 are connected in series between power supplies VDD and VSS, and p-channel transistors MP4 and MP5 and n-channel transistors MN6 and MN7 are connected in series between power supplies VDD and VSS.

Into a gate of the p-channel transistor MP1, a gate of the n-channel transistor MN3, and a gate of the n-channel transistor MN7, the set signal barred-S is inputted. Into a gate of the p-channel transistor MP4 and a gate of the n-channel transistor MN2, the reset signal R is inputted. Further, a junction of the p-channel transistor MP1 and the n-channel transistor MN2 is connected to a junction of the p-channel transistor MP5 and the n-channel transistor MN6 and to an inverter circuit INV1.

Further, an output of the inverter circuit INV1, connected to a gate of the n-channel transistor MN6 and a gate of the p-channel transistor MP5 and to an inverter circuit INV2, becomes an output Q serving as an output of the RS flip-flop.

Operation of the RS flip-flop of the foregoing arrangement will be described below.

As shown in FIGS. 5(*a*) and 5(*b*), when the set signal barred-S is inputted to reach a low level, the p-channel transistor MP1 is turned on and the n-channel transistor MN3 is turned off. Further, at this time, a level of the reset signal R is low, and the n-channel transistor MN2 is turned off, and the p-channel transistor MP4 is turned on. In this state, since the junction of the p-channel transistor MP1 and the n-channel transistor MN2 is a power supply VDD (high), an input signal into the inverter circuit INV1 is a power supply VDD (high), so that an output of the inverter circuit INV1 is low in voltage.

At the same time, the set signal barred-S is inputted into the n-channel transistor MN7, so that the n-channel transistor MN7 is turned off. Further, the output of the inverter circuit INV1 is low in voltage, so that the n-channel transistor MN6 is also turned off, and the p-channel transistor MP5 is turned on. At this time, the output signal Q of the RS flip-flop is outputted as a signal whose level is high.

Then, when a voltage of the set signal barred-S becomes high, the p-channel transistor MP1 is turned off, and the n-channel transistors MN3 and MN7 are turned on. Meanwhile, the reset signal R is still low in voltage, so that the n-channel transistor MN2 is turned off, and the p-channel transistor MP4 is turned on. Therefore, the output signal Q remains high in voltage.

Then, when the reset signal R becomes high in voltage, the n-channel transistor MN2 is turned on, and the p-channel transistor MP4 is turned off. This causes the input into the inverter circuit INV1 to become low in voltage, so that the output of the inverter circuit INV1 becomes high in voltage. Further, the output of the inverter circuit INV1 turns on the n-channel transistor MN6 and turns off the p-channel transistor MP5. Therefore, the output signal Q becomes low in voltage.

Then, when the reset signal R becomes low in voltage, the input of the inverter circuit INV1 remains low in voltage since the n-channel transistors MN6 and MN7 are turned on. The output signal Q is also outputted as a signal whose level is low.

Note that, a combination of the RS flip-flop and the level shifter described in the conventional example can constitute the shift register 1 shown in FIG. 4.

Figure 7:
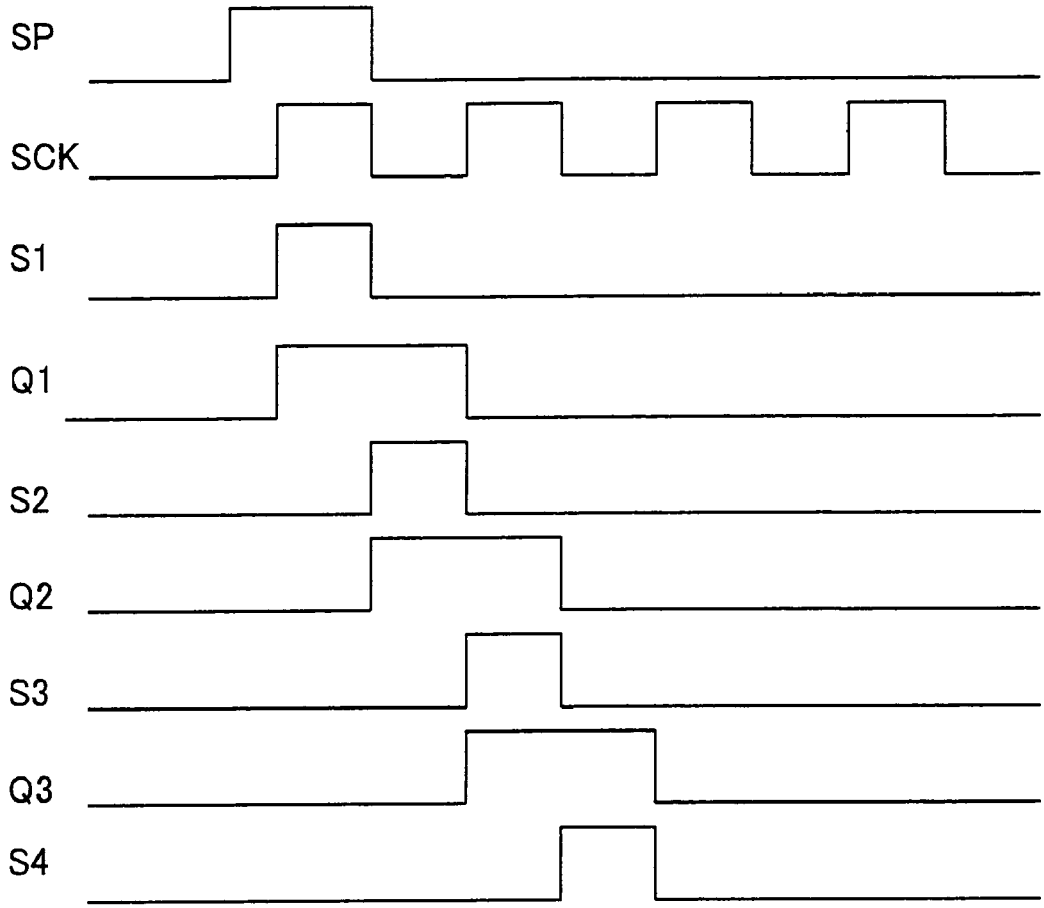
FIG. 7 is a timing chart showing waveforms of input-output signals of the shift register using the reset-set flip-flop.

Operation of the shift register 1 shown in FIG. 4 will be described with reference to FIG. 4 and a timing chart shown in FIG. 7.

As shown in FIG. 4, when a source start signal SSP is first inputted, the source start signal SSP is boosted by the source start signal level shifter LS0 up to a power supply voltage of the shift register 1 and is inputted into an ENA terminal of the clock level shifter LS1.

The clock level shifters LS1 to LSn+1 of the present embodiment are arranged so as to operate only when an ENA signal is high in voltage. Therefore, while the source start signal SSP is high in voltage, the clock level shifter LS1 operates to take in a source clock signal SCK, so that a signal boosted up to the power supply voltage of the shift register 1 is outputted as an output S1. The output S1 is inverted by the inverter circuit INVS1, and is inputted into an RS flip-flop F1, and is generated as an output signal Q1. The output signal Q1 is inputted into an ENA terminal of the clock level shifter LS2 to activate the clock level shifter LS2 and is outputted as an output S2 from the clock level shifter LS2. As with the output S1, the output S2 is inverted by the inverter circuit INVS2, and is inputted into an RS flip-flop F2, and is generated as an output signal Q2. At this time, since the source start signal SSP is already low in voltage, the clock level shifter LS1 is in a non-operating state. On this account, hereafter, the RS flip-flop F1 will not operate until the next time the source start signal SSP becomes high in voltage. The output signal Q2 of the RS flip-flop F2 is inputted into an ENA terminal of the clock level shifter LS3 to boost the source clock signal SCK, so that the output signal Q2 is outputted as an output S3 from the clock level shifter LS3. Further, the output S3 is inverted by the inverter circuit INVS3, and is inputted into an RS flip-flop F3, and is inputted into a reset terminal of the RS flip-flop F1, so that the output signal Q1 of the RS flip-flop F1 becomes low in voltage.

The shift register 1 operates by repeating the operations described above.

Figure 8:
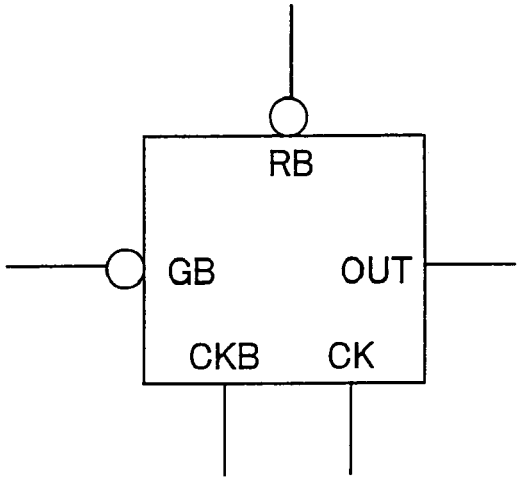
FIG. 8 is a diagram showing a basic structure of the reset-set flip-flop in the shift register of the data signal line driving circuit.

Note that, in the present embodiment, not only the foregoing arrangement example of the shift register 1 but also another arrangement of the shift register 1 shown below can be adopted. Further, as shown in FIG. 8, an RS flip-flop will be described below which has terminals respectively corresponding to a control signal GB, a clock signal CK, and its inverse clock signal CKB, a reset signal RB, and an output signal OUT.

Figure 9:
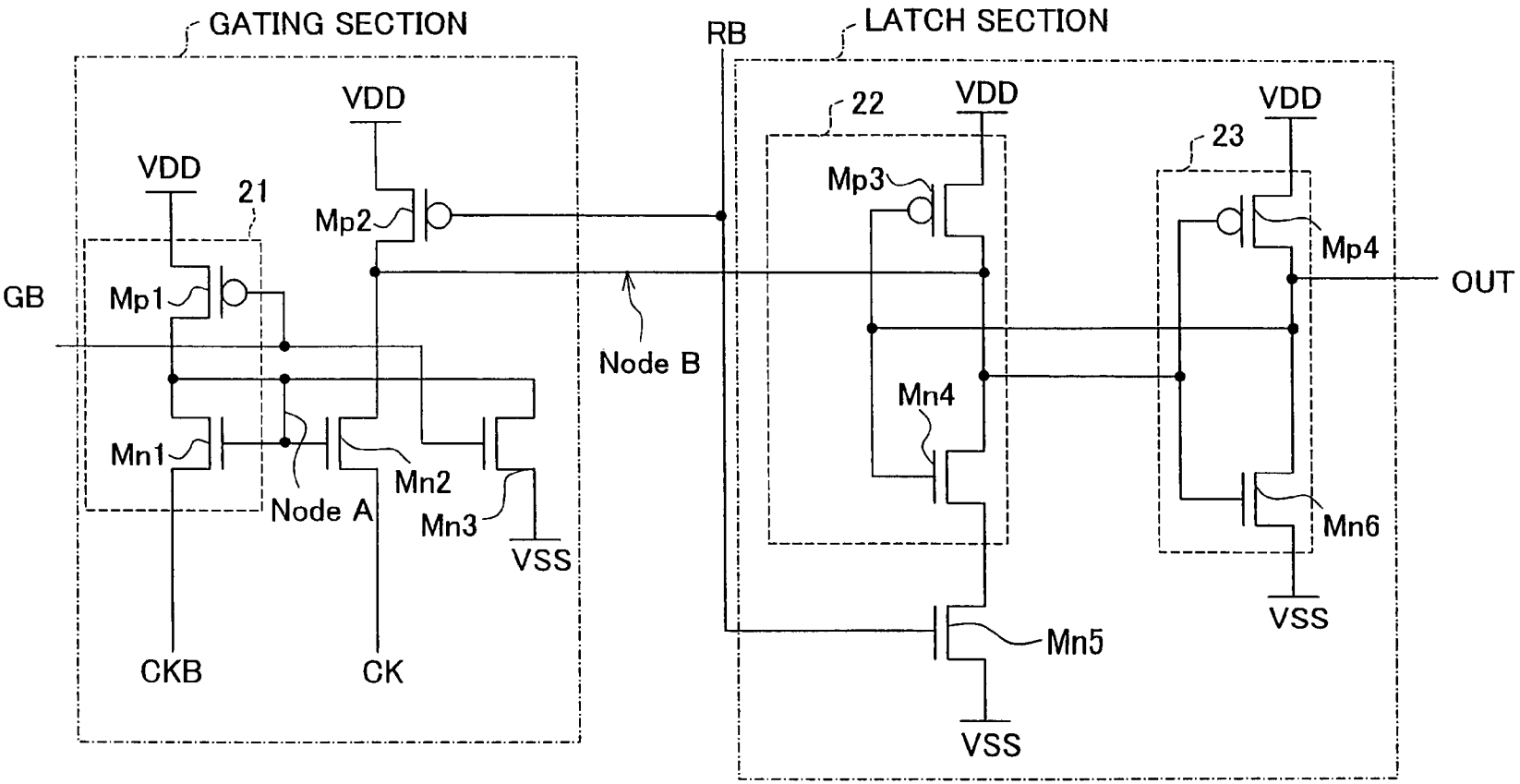
FIG. 9 is a block diagram showing a detailed structure of the reset-set flip-flop.

As shown in FIG. 9, the RS flip-flop receives a control signal GB, a clock signal CK, and its inverse clock signal CKB, and a reset signal RB. Further, each of the clock signal CK and the inverse clock signal CKB has a voltage of 3.3V and a smaller amplitude, i.e., a smaller voltage than a voltage (8V) of the power supply VDD of the main circuit.

The RS flip-flop is constituted of a gating section and a latch section. The gating section is a function section which supplies a clock signal CK and its inverse clock signal CKB, serving as externally inputted signals, to the latch section at a following stage in accordance with a control signal GB and a reset signal RB inputted separately from the inputted signals. The latch section is a function section which latches the inputted signals supplied from the gating section.

In the gating section, a p-channel transistor Mp1 and an n-channel transistor Mn1 (hereinafter a "p-channel transistor" and a "n-channel transistor" are referred to as a "transistor Mp" and a "transistor Mn" respectively) are connected in series between a power supply VDD (high-voltage) and an input terminal CKB, thereby constituting an inverter circuit 21. Further, transistors Mp2 and Mn2 are connected in series between a power supply VDD and a terminal for a clock signal CK serving as an input signal. Further, a transistor Mn3 is disposed between a drain of the transistor Mp1 and a power supply VSS.

Into a gate of the transistor Mp1 and a gate of the transistor Mn3 respectively, a control signal GB is inputted. Further, drains of the transistors Mp1, Mn1, and Mn3 are respectively connected to gates of the transistors Mn1 and Mn2, and a gate of the transistor Mp2 is connected to a terminal for a reset signal RB.

Further, drains of the transistors Mp2 and Mn2 are respectively connected to drains of transistors Mp3 and Mn4 in the latch section.

Meanwhile, the latch section has: an inverter circuit 22, which is constituted of the transistors Mp3 and Mn4 between a power supply VDD (high-potential) and a power supply VSS (low-potential); and an inverter circuit 23, which is constituted of transistors Mp4 and Mn6 between a power supply VDD (high-potential) and a power supply VSS (low-potential).

The inverter circuit 22 has its input connected to an output of the inverter circuit 23; the inverter circuit 23 has its input connected to an output of the inverter circuit 22. In this way, the inverter circuit 22 and the inverter circuit 23 constitute a latch circuit. That is, the input of the inverter circuit 22 is connected to the output of the inverter circuit 23, and the output of the inverter circuit 22 is connected to the input of the inverter circuit 23. Further, a transistor Mn5 is disposed between the transistor Mn4 of the inverter circuit 22 and the power supply VSS, and an RB terminal of the reset signal RB is connected to a gate of the transistor Mn5.

An output of the inverter circuit 21, i.e., an output from the drains of the transistors Mp1 and Mn1 is a node (Node) A, and an output of the gating section, i.e., an output from the drains of the transistors Mp2 and Mn2 is a node (Node) B. Further, the output of the inverter circuit 23 in the latch section is an output signal OUT.

It is assumed, for example, that: in the RS flip-flop of the foregoing arrangement, each of a clock signal CK and an inverse clock signal CKB has an amplitude of 3.3V, and a power supply VDD of the circuit has a voltage of 8V, and a power supply VSS has a voltage of 0V. Further, it is assumed that n-channel transistors Mn1 to Mn6 have a threshold voltage of 3.5V.

For example, in case where the inverse clock signal CKB receives a low voltage (=0V) and the clock signal CK receives a voltage of 3.3V when the reset signal RB is high in voltage and the terminal for the control signal GB is low in voltage, the transistor Mp1 is in a conductive state and the transistor Mn1 exhibits a diode-like function. Thus, the node (Node) A keeps a potential of around 3.5V, which is proximate to the threshold voltage of the transistor Mn1.

At this time, the clock signal CK is connected to a source of the transistor Mn2 and the node (Node) A is connected to the gate of the transistor Mn2, so that the transistor Mn2 has a gate-source voltage of approximately 0.2V and a threshold voltage of 3.5V. Therefore, the transistor Mn2 is in a non-conductive state.

Meanwhile, when the inverse clock signal becomes 3.3V and the clock signal CK becomes 0V, a potential of approximately 6.8V (=a threshold voltage of 3.5V of the transistor Mn1+a voltage of 3.3V of the inverse clock signal CKB) is generated in the node (Node) A. At this time, because the clock signal CK is 0V, a source-gate voltage of the transistor Mn2 becomes approximately 6.8V. Therefore, the transistor Mn2 has a threshold voltage of 3.5V, so that the transistor Mn2 is in a conductive state, and the node (Node) B becomes 0V.

Therefore, in the gating section, an output of the node (Node) B can be controlled by turning on and off the clock signal CK and the inverse clock signal CKB. In the latch section, the output of the node (Node) B in the gating section can be latched by turning off the reset signal RB in the same driving manner.

Figure 10:
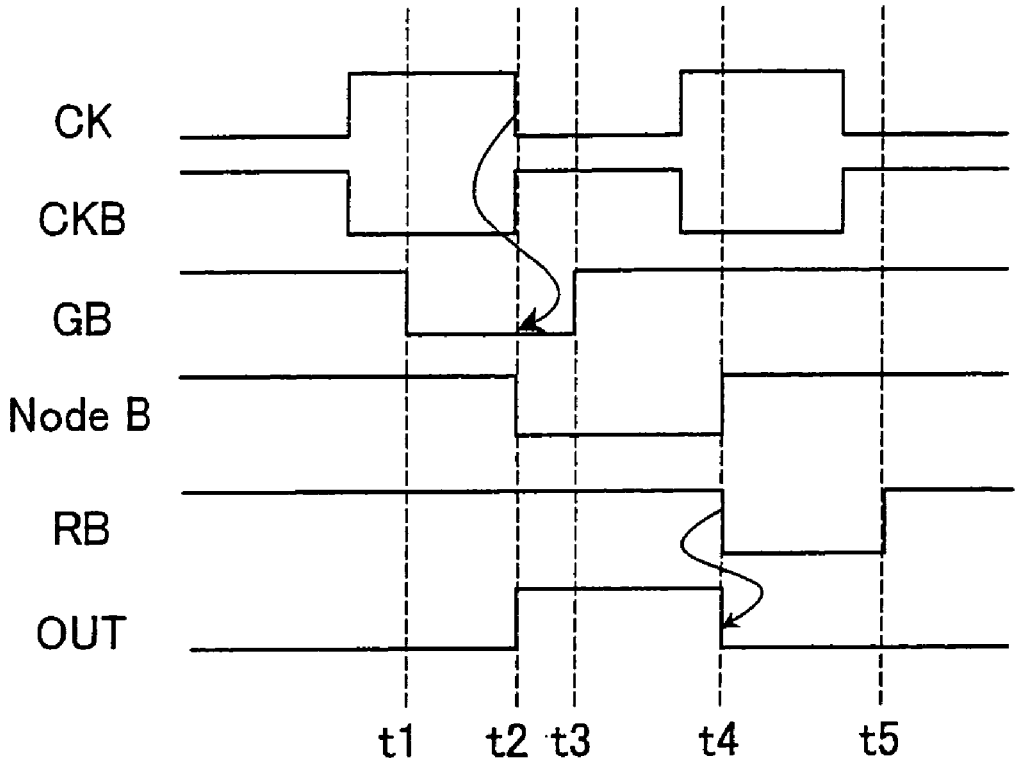
FIG. 10 is a timing chart showing waveforms of input-output signals of the reset-set flip-flop.

In the following, operation of the RS flip-flop is described with reference to a timing chart shown in FIG. 10.

First, the control signal GB becomes low in voltage in time t1, so that the transistor Mp1 becomes conductive and the transistor Mn3 becomes non-conductive. At this time, as described above, the inverse clock signal CKB has a voltage of 0V, and the clock signal CK has a voltage of 3.3V, and the transistor Mn1 has a threshold voltage of 3.5V, so that a gate electrical potential of the transistor Mn2, i.e., a potential of the node (Node) A becomes a high voltage of approximately 3.5V. Therefore, the transistor Mn2 has a source electrical potential of 3.5V, so that the transistor Mn2 is in a non-conductive state.

At this time, because the reset signal RB has a high voltage (=8V), the transistor Mp2 is in a non-conductive state. Therefore, when the reset signal RB has a high voltage (=8V), the node (Node) B keeps a high voltage without changing its status. That is, in the latch section, when the reset signal RB has a high voltage (=8V), the transistor Mn5 is in a conductive state, and the transistor Mp3 and the transistor Mn4 act as the inverter circuit 22. Further, the inverter circuit 22 constitutes the latch circuit in combination with the inverter circuit 23 constituted of the transistor Mp4 and the transistor Mn6, so that the node (Node) B connected to the latch section does not change its status when the transistor Mp2 is in a non-conductive state.

Next, when a clock pulse is inverted in terms of an on/off state to cause the inverse clock signal CKB to have a voltage of 3.3V and the clock signal CK to have a voltage of 0V in time t2, the node (Node) A has a voltage of approximately 6.8V (=a threshold voltage of 3.5V of the transistor Mn1+3.3 V), and the potential of 6.8V is applied to the gate of the transistor Mn2. At this time, the source of the transistor Mn2 has the clock signal CK with a voltage of 0V, so that the transistor Mn2 becomes conductive, thereby causing the node (Node) B to be low in voltage. At this time, the reset signal RB still has a high voltage (=8V), so that the transistor Mp2 is in a non-conductive state, and the transistor Mn5 is in a conductive state, and the transistor Mp3 and the transistor Mn4 function as the inverter circuit 22. Therefore, when the node (Node) B becomes low in voltage, the latch circuit constituted of the inverter circuit 22 and the inverter circuit 23 changes its status, so that the output signal OUT becomes a high voltage (=8V).

Next, in time t3, the control signal GB becomes high in voltage (power supply VDD=8V), so that the transistor Mp1 becomes non-conductive and the transistor Mn3 becomes conductive. Thus, a low voltage (power supply VSS=0 V) is applied to the gates of the transistors Mn1 and Mn2, so that the transistors Mn1 and Mn2 are in a non-conductive state and are not affected by the clock signal CK and the inverse clock signal CKB. Accordingly, when the control signal GB has a high voltage (power supply VDD=8V), the gating section will not be affected whatever status the clock signal CK and the inverse clock signal CKB may have. At this time, the node (Node) B is not affected by the clock signal CK due to a non-conductive state of the transistor Mn2, but is kept low in voltage by the latch circuit constituted of the inverter circuit 22 and the inverter circuit 23. As a result, the output signal OUT is kept high in voltage (power supply VDD=8V).

Next, in time t4, the reset signal RB becomes low in voltage (power supply VSS=0V), and the transistor Mp2 is in a conductive state. At the same time, the reset signal RB is supplied also to the gate of the transistor Mn5, so that the transistor Mn5 is in a non-conductive state, and the circuit constituted of the transistor Mp3 and the transistor Mn4 no longer functions as the inverter circuit 22. Accordingly, the node (Node) B becomes high in voltage (power supply VDD=8V) when the transistor Mp2 is in a conductive state, so that the transistor Mn6 of the inverter circuit 23 is in a conductive state, thereby causing the output signal OUT to be a low voltage (power supply VSS=0V).

Finally, in time t5, the reset signal RB becomes high in voltage, and the transistor Mp2 is in a non-conductive state, and the transistor Mn5 is in a conductive state. At this time, the circuit constituted of the transistors Mn4 and Mp3 functions again as the inverter circuit 22, so that the inverter circuit 22 and the inverter circuit 23 function again as the latch circuit. This keeps the node (Node) B in a high state, and as a result keeps the output signal OUT low in voltage.

Figure 11:
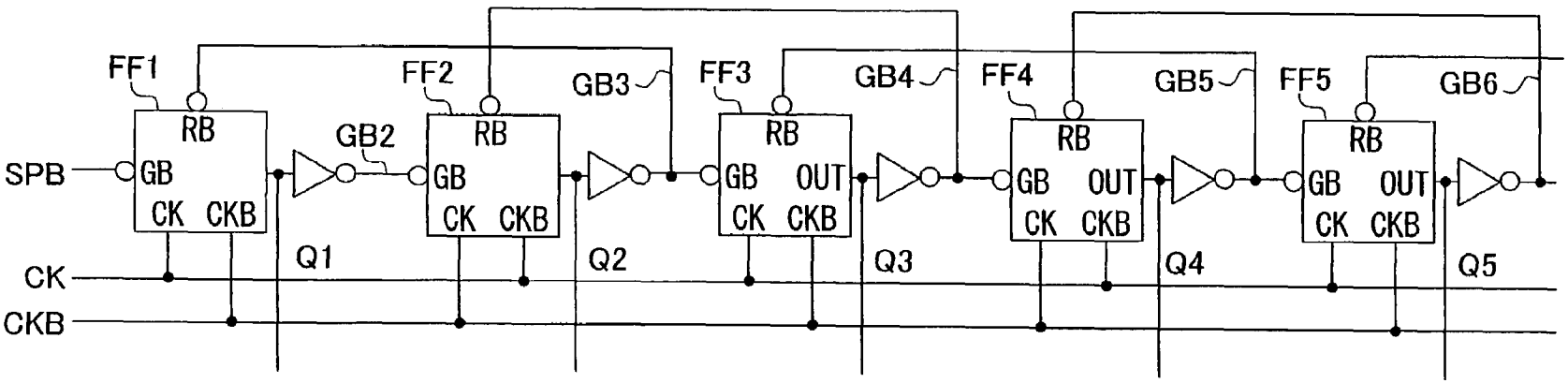
FIG. 11 is a block diagram showing an arrangement of the shift register using the reset-set flip-flop.

An example of an arrangement of the shift register 1 using the RS flip-flop of the foregoing arrangement is shown in FIG. 11. Note that, FIG. 11 is an example of an arrangement of the shift register 1 using the RS flip-flop shown in FIG. 9.

The shift register 1 has a plurality of RS flip-flops FF1, FF2, . . . connected in series. The clock signal CK is connected to a CK terminal of an RS flip-flop FFa (a=2n−1, n=1, 2, . . . ), and the inverse clock signal CKB is connected to a CKB terminal thereof.

Meanwhile, the inverse clock signal CKB is connected to a CK terminal of an RS flip-flop FFa (a=2n, n=1, 2, . . . ), and the clock signal CK is connected to a CKB terminal thereof. Thus, the clock signal CK and the inverse clock signal CKB connected to the CK and CKB terminals of the odd-numbered RS flip-flop FFa (a=2n−1, n=1, 2, . . . ) are inversely related to those connected to the CK and CKB terminals of the even-numbered RS flip-flop FFa (a=2n, n=1, 2, . . . ).

Further, in the shift register 1, a start pulse signal SPB is inputted into a GB terminal of the RS flip-flop FF1, and an output signal OUT of the RS flip-flop FFa at each stage is outputted as output signals Q1, Q2, Q3, serving as an output of the shift register 1. Further, the output signals Q1, . . . in the RS flip-flops at respective stages are respectively connected as control signals GB2, . . . thorough respective inverters to a GB terminal of an RS flip-flop FF at a next stage.

Further, in the RS flip-flops FF2, FF3, . . . at a second or further stage, each of inverse signals of the output signals Q2, Q3, . . . is inputted into a GB terminal at a next stage and is also connected to an RB terminal of an RS flip-flop at a previous stage so as to be used as a reset signal. For example, a control signal GB3, which is an inverse signal of the output signal Q2 of the RS flip-flop FF2 at the second stage, is connected to a GB terminal of the RS flip-flop FF3 at a third stage and an RB terminal of the RS flip-flop FF1 at the first stage.

Figure 12:
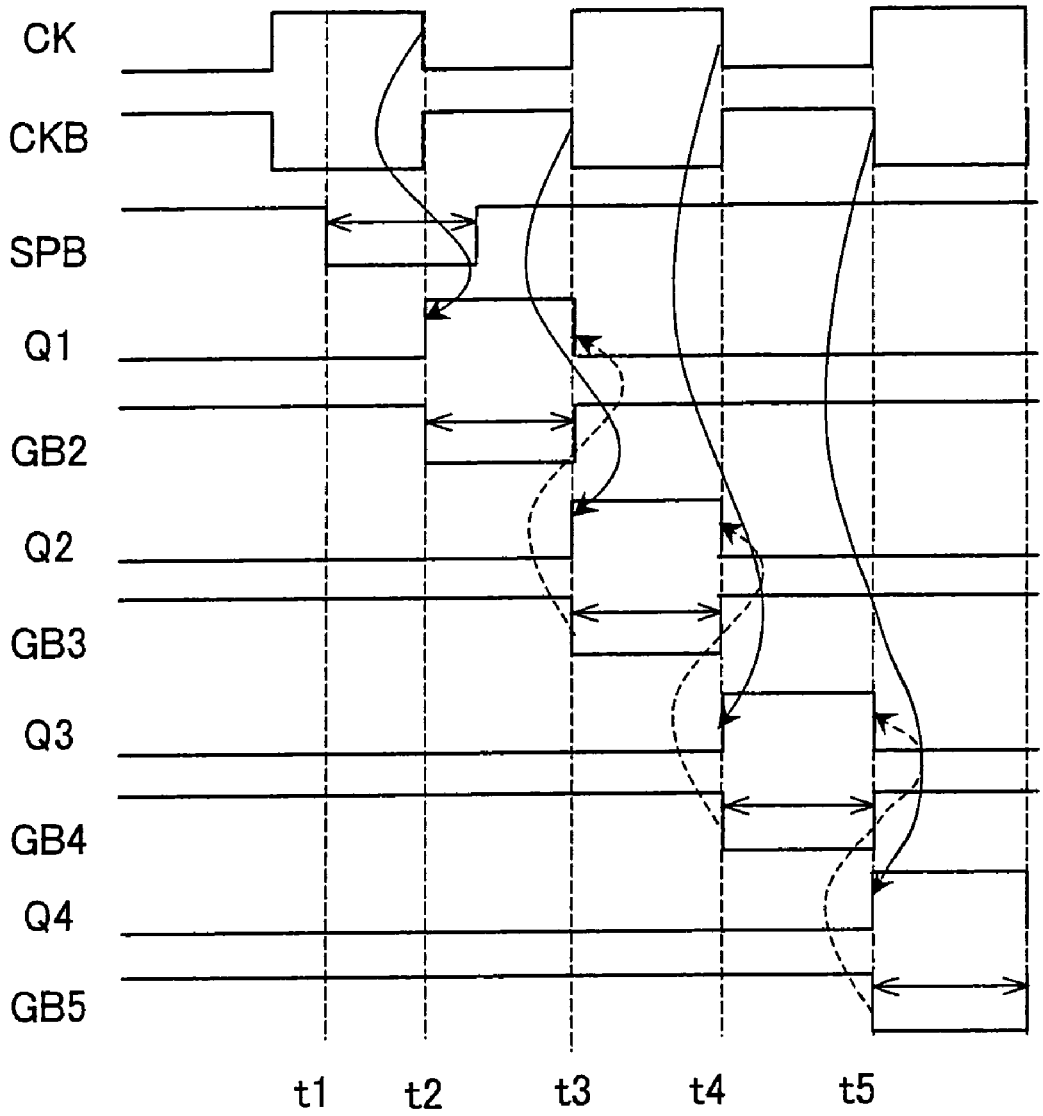
FIG. 12 is a timing chart showing waveforms of input-output signals of the shift register using the reset-set flip-flop.

In the following, operation of the shift register will be described with reference to a timing chart of FIG. 12.

First, after the start pulse signal SPB is inputted into the GB terminal of the RS flip-flop FF1 in time t1, the clock signal CK becomes low in voltage in time t2, so that an OUT signal of the RS flip-flop FF1, i.e., the output signal Q1 becomes high in voltage. Further, the output signal Q1 is inputted as a control signal GB2 into a GB terminal of the RS flip-flop FF2, so that a low-voltage signal is inputted to the GB terminal of the RS flip-flop FF2.

Then, under such condition that the control signal GB2 with a low voltage inputted into the GB terminal of the RS flip-flop FF2, the inverse clock signal CKB becomes low in voltage in time t3, so that an OUT signal of the RS flip-flop FF2, i.e., the output signal Q2 becomes high in voltage. Further, the control signal GB3, which is the inverse signal of the output Q2, becomes low in voltage. The control signal GB3 is inputted into the GB terminal of the RS flip-flop FF3 and is inputted also into the RB terminal of the RS flip-flop FF1, so that the RS flip-flop FF1 is reset, thereby causing the output Q1 to become low in voltage.

Thus, the reset-set flip-flops connected in series functions as a shift register 1 in synchronism with a clock signal CK and an inverse clock signal CKB. The shift register 1 operates in the same manner even when the clock signal CK and the inverse clock signal CKB have lower amplitude than a power supply VDD of a circuit.

Incidentally, as to the shift register 1, in the level shifter LS of FIG. 4 and in the gating section of FIG. 9, when the control signal GB is low in voltage, each of the level shifter LS and the transistor Mp1 of the gating section is in a current-driven mode, in which each of them is conductive all times and a current of a current generator, i.e., an invalid current is allowed to flow, regardless of whether the clock signal CK/the inverse clock signal CKB is on or off. Therefore, this is not advantageous in view of power consumption reduction.

Accordingly, a method which reduces power consumed by the invalid current is adopted in the driving device 2 of the present embodiment, the liquid display device 11, and the driving method of the liquid display device 11.

Here, the liquid crystal display device 11 of the present embodiment is arranged so that partial display can be performed, so that an arrangement for performing partial display will be described first.

Figure 13:
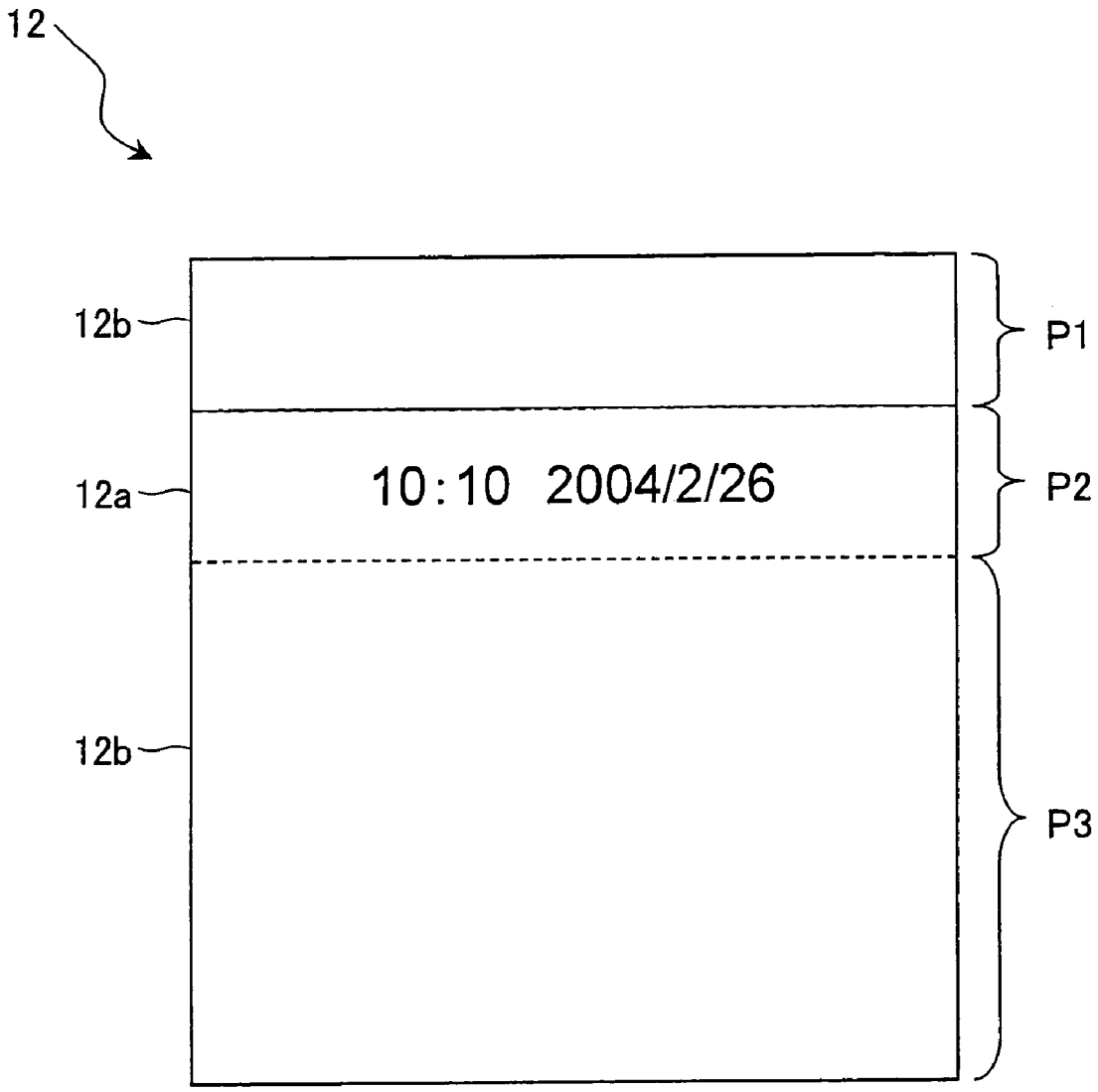
FIG. 13 is a front view showing a display state of a display screen in a partial display mode of the liquid crystal display device.

That is, the liquid crystal display device 11 of the present embodiment can be used as a display device of a mobile phone. As shown in FIG. 13, the liquid crystal display device 11 is arranged so as to cause the display area of the display screen to perform time-sharing display, i.e., partial display. In the partial display mode, the display area is for example divided into three areas P1, P2, and P3. And, in a full-screen display mode in which a whole of the display screen 12 performs display, the areas P1, P2, and P3 are used to perform display in a full-color mode. Meanwhile, in a waiting state, a partial-screen display mode is used in which only a part of the display screen 12 performs display. The full-screen display mode and the partial-screen display mode are switched over by the control circuit 15 serving as mode switching means based on a switching selection switch (not shown). For example, the areas P1 and P3 serve as nondisplay portions 12*b* each of which displays nothing but a white background, and the area P2 displays a static image such as time and wallpaper.

Figure 1:
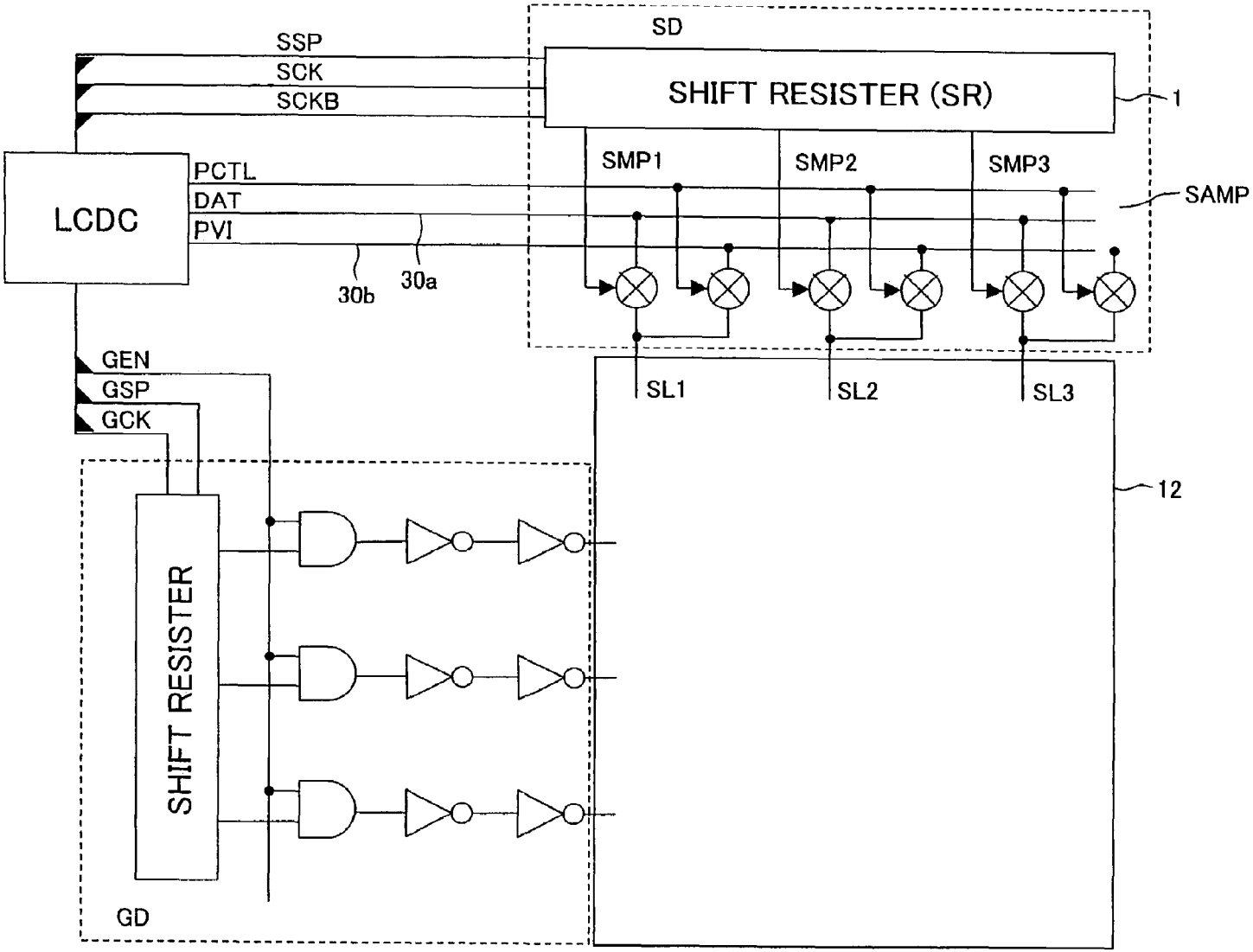
FIG. 1, showing one embodiment of a liquid crystal display device according to the present invention, is a block diagram showing a detailed structure of a driving device of the liquid crystal display device.

Specifically, as shown in FIG. 1, the driving device 2, which performs partial display as described above, is arranged so that: (i) a first wiring 30*a* for supplying a multi-gradation data signal DAT to a data signal line driving circuit SD and (ii) a second wiring 30*b* for supplying a constant voltage data writing signal PVI, made of a voltage or a pre-charge voltage to be applied at the time of constant uniform color display, to the data signal line driving circuit SD allow the respective signals to be supplied to a sampling circuit SAMP of the data signal line driving circuit SD. The constant voltage data writing signal is made of a lower voltage than the multi-gradation data signal DAT and is generated in a data generating section LCDC serving as constant voltage data writing signal generation means. Note that, a liquid crystal driving method is a 1H inverse driving (single horizontal scanning period inverse driving) method, and a polarity of the constant voltage data writing signal PVI is inverted in every single horizontal scanning period.

That is, conventionally, as shown in FIG. 17, white data for a nondisplay portion has been written in the areas P1 and P3 in a waiting state by using a source clock signal SCK having the same frequency as the area P2 in which image data for a display portion is written. Moreover, the white data for the nondisplay portion has been written by using multi-gradation display data. Therefore, there has been such a problem that the use of the multi-gradation display data causes an invalid current of the level shifter LS to increase power consumption.

Accordingly, in the present embodiment, the white display of the nondisplay portion is performed by writing a potential for white display with the constant voltage data writing signal PVI. The constant voltage data writing signal PVI, as described above, is generated in the data generating section LCDC.

Also, in the present embodiment, the data generating section LCDC separately supplies to the sampling circuit SAMP a selection signal PCTL for selecting the constant voltage data writing signal PVI. Therefore, the constant voltage data writing signal PVI is selected by the selection signal PCTL to be outputted to a data signal line SL without passing through the shift register 1. Meanwhile, the multi-gradation data signal DAT is selected by the flip-flop circuit FF from the shift register SR of the data signal line driving circuit SD to be outputted to the data signal line SL.

Therefore, the white display of the nondisplay portion is performed by writing an electrical potential for white display with the constant voltage data writing signal PVI without using the shift register 1, so that it is possible to reduce power consumed by an invalid current of the level shifter LS.

A driving method for performing partial display in the liquid crystal display device 11 of the foregoing arrangement will be described with reference to a timing chart of FIG. 14. Note that, FIG. 14 shows a timing chart in a waiting state.

Figure 14:
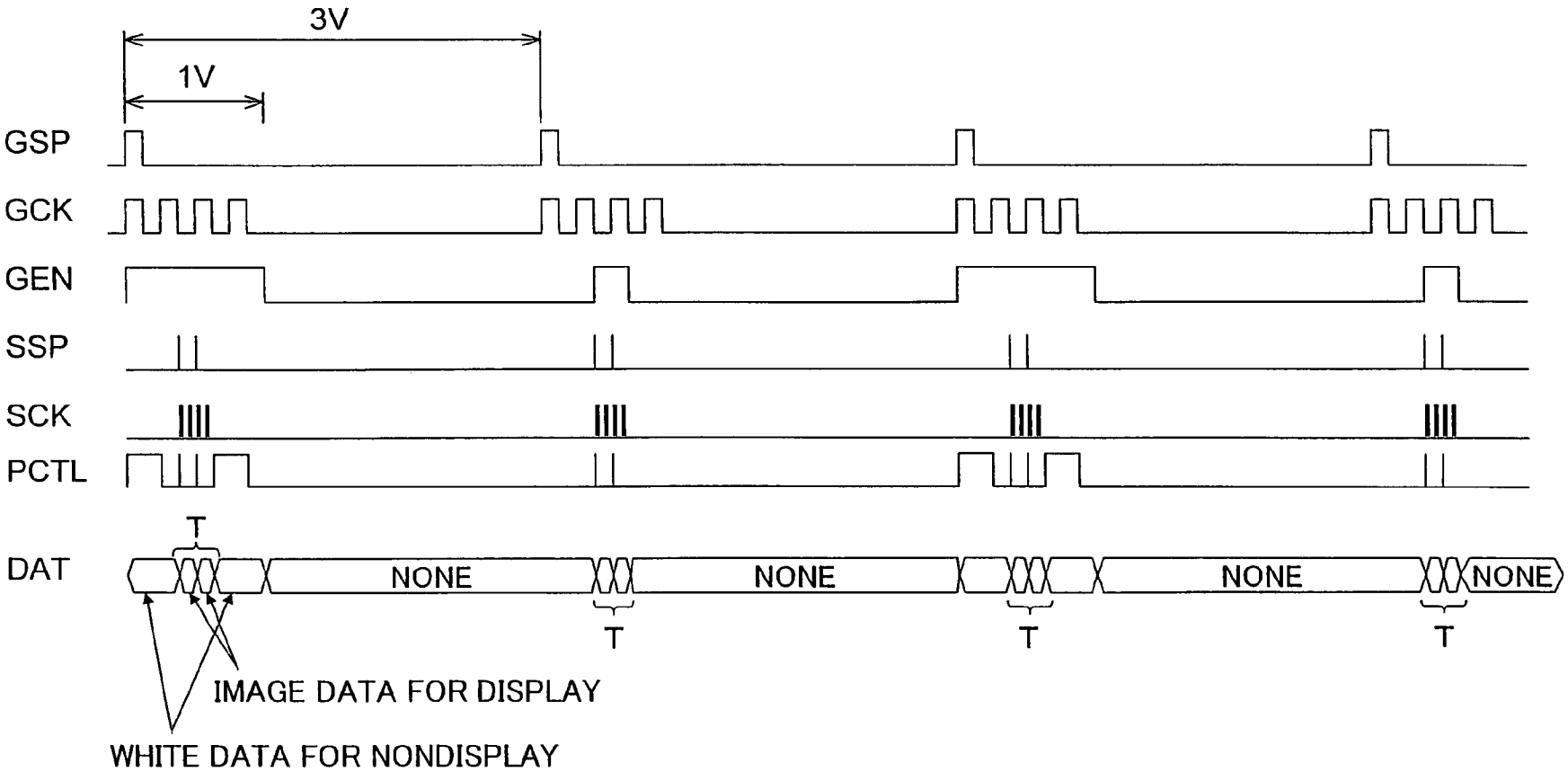
FIG. 14 is a timing chart showing a display state of a display screen in a partial display mode of the liquid crystal display device.
Figure 15:
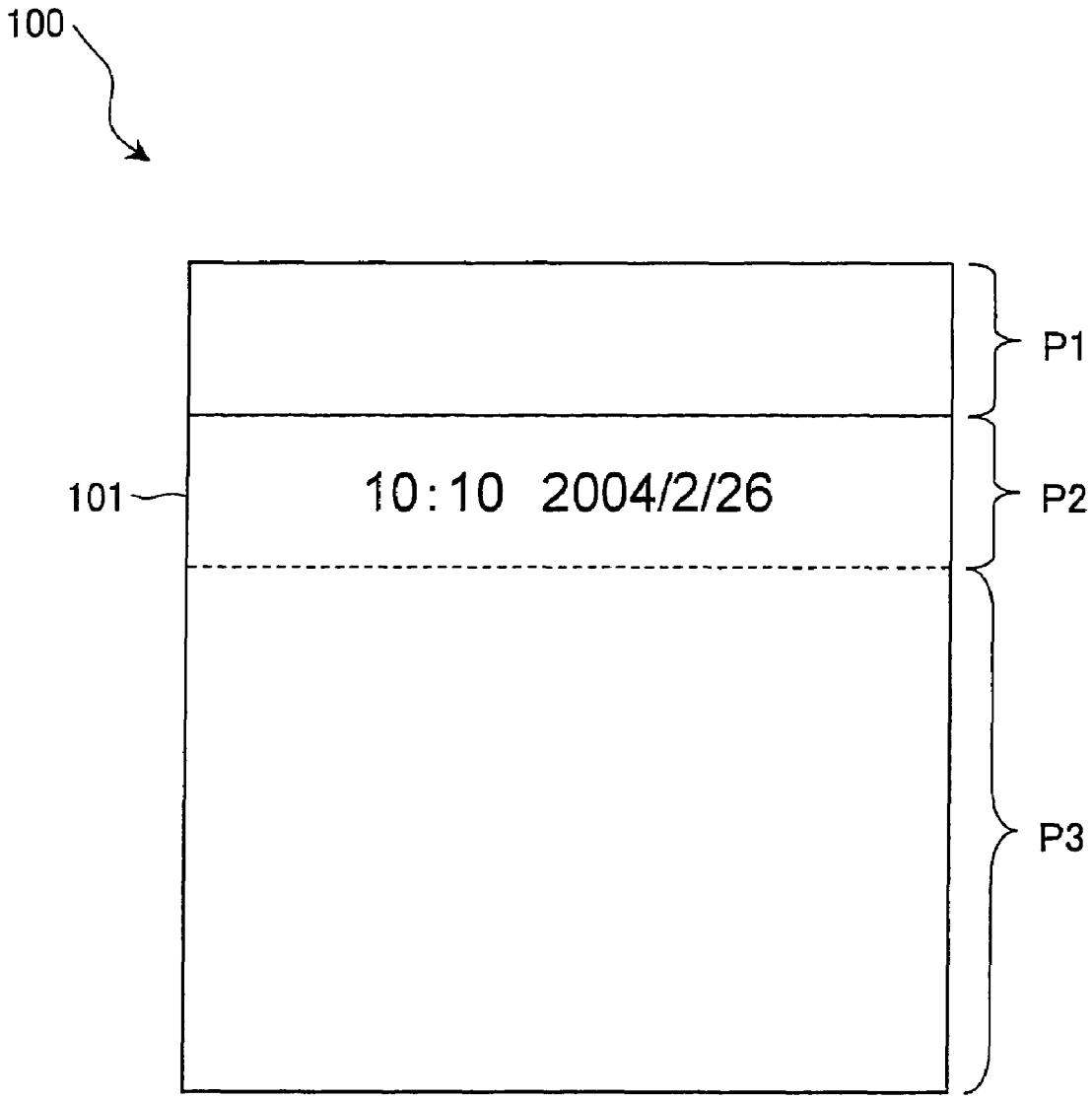
FIG. 15 is a front view showing a display state of a display screen in a partial display mode of a conventional liquid crystal display device.
Figure 16:
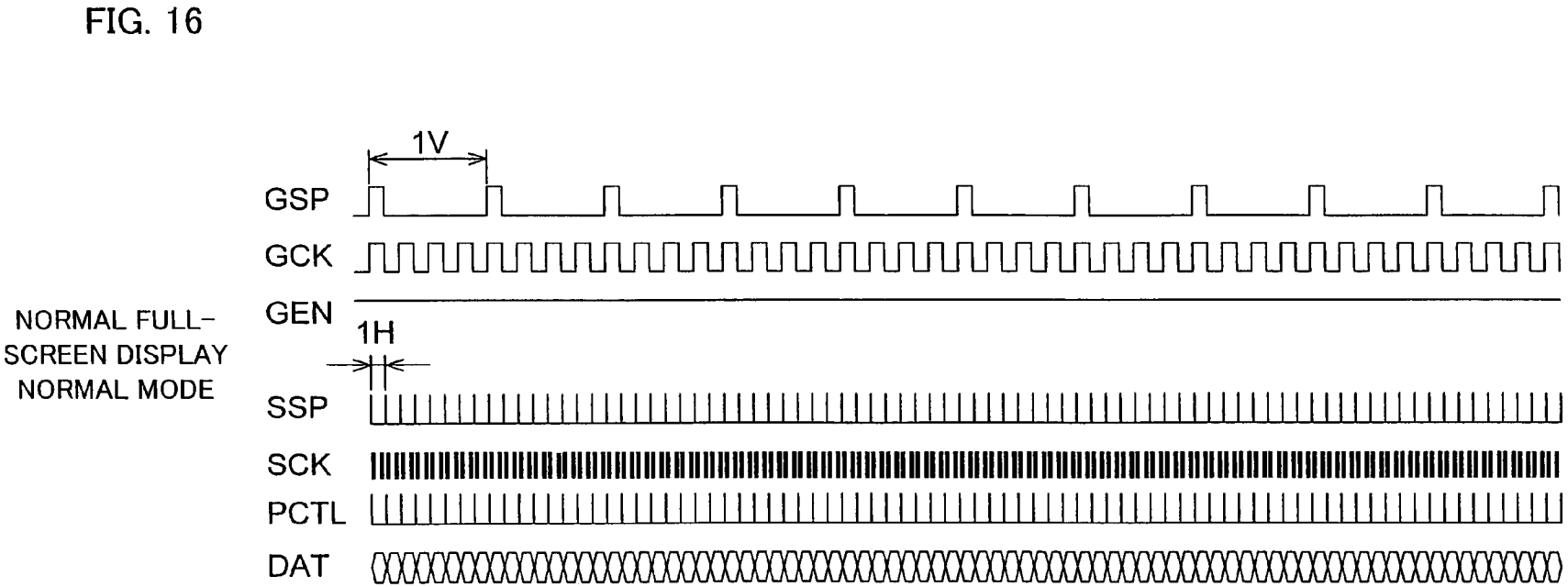
FIG. 16 is a timing chart showing waveforms of input-output signals in a full-screen display mode of the liquid crystal display device.

In the present embodiment, as shown in FIG. 14, in a waiting state, display is performed once in every three vertical scanning period (3V). Therefore, a gate clock signal GCK and a gate start pulse GSP, as well as a source clock signal SCK and a source start pulse SSP are activated only in a first vertical scanning period (1V) and are stopped in a second vertical scanning period and a third vertical scanning period, thereby stopping circuit operation.

Even when driven in such a manner, a liquid crystal, having a characteristic of retaining display, keeps displaying a static image. This makes it possible to stop a driving circuit intermittently by skipping display-driving frames intermittently, thereby reducing power consumption.

Further, in the present embodiment, the white data of the background in display of the areas P1 and P3 can be free from any display problem even at a lower refresh rate (rewrite rate), so that an image based on the white data for nondisplay is displayed every six vertical scanning periods (6V), and the data signal line driving circuit SD is stopped in a third scanning period, a ninth scanning period, . . . in this while, thereby reducing power consumption.

In addition to the reduction of power consumption, in the present embodiment, as described above, a potential for white display is written by the constant voltage data writing signal PVI, thereby performing white display in the nondisplay portion in the areas P1 and P3. Therefore, in the areas P1 and P3, the selection signal PCTL continues to be high in voltage. And, in a period T in which the area P2 is caused to perform display, the selection signal PCTL is intermittently caused to become high in voltage, and image data for the display portion is written after a pre-charge voltage is applied by the constant voltage data writing signal PVI. The driving methods make it possible to reduce power consumption.

Note that, although the 1H inverse driving method has been described above, this is not for limitation, but other liquid crystal display driving methods such as a frame inversion driving method and a dot inversion driving method can also be applied.

Thus, the driving device 2 of the liquid crystal display device 11 and the driving method of the liquid crystal display device 11 of the present embodiment are arranged as follows. The driving device 2 of the liquid crystal display device 11 includes: the shift register 1 which has (i) multiple stages of flip-flops FF each of which operates in synchronism with a source clock signal SCK and (ii) a level shifter LS for boosting the source clock signal SCK whose amplitude is smaller than a drive voltage of each of the flip-flops FF so as to apply the drive voltage to the flip-flop FF; and a data signal line driving circuit SD for causing a sampling circuit to sample an image display data signal based on an output from the shift register 1 so as to output the image display data signal to the plurality of data signal lines SL.

Therefore, when the driving device 2 of the liquid crystal display device 11 is driven, an invalid current of a transistor of the level shifter LS constantly flows, so that power is consumed even when a data signal is not outputted to the data signal line SL.

Meanwhile, in the present embodiment, the full-screen display mode in which a whole of the display screen 12 performs display and the partial-screen display mode in which only a part of the display screen 12 performs time-sharing display are switched over by the control circuit 15. That is, a partial display mode is adopted.

Here, the partial mode, used for example in a display device of a mobile device such as a mobile phone, is a mode in which an image is partially displayed in a waiting state. Further, since a waiting state occupies a longer period of time, there is particularly a need for reducing power consumption.

Accordingly, in the present embodiment, the control circuit 15, serving as constant voltage data selection means, has a data generating section LCDC for generating a constant voltage data signal PVI made of a constant voltage, and outputs a selection signal for causing the areas P1 and P3 serving as nondisplay portions, except for the area P2 serving as that part of the display screen 12 which performs time-sharing display in the partial-screen display mode, to directly sample a constant voltage data writing signal PVI from the data generating section LCDC so as to output the constant voltage data writing signal PVI to each of a plurality of data signal lines SL.

Therefore, the selection signal PCTL can cause the areas P1 and P3 in the partial-screen display mode to directly sample a constant voltage data writing signal PVI from the data generating section LCDC so as to output the constant voltage data writing signal PVI to each of a plurality of data signal lines SL.

As a result, the area P1 and P3, serving as nondisplay portions in the partial-screen display mode, are caused to output the constant voltage data writing signal PVI to each of the data signal lines SL without using the shift register 1 having the level shifter LS, so that there is no need for driving the level shifter LS. This prevents an invalid current of a transistor in the level shifter LS from constantly flowing, thereby reducing power consumption.

Therefore, it is possible to provide the driving device 2 of the liquid crystal display device 11 and the driving method of the liquid crystal display device 11 whereby reduction of power consumption can be realized.

Further, according to the driving device 2 of the liquid crystal display device 11 and the driving method of the liquid crystal display device 11 of the present embodiment, the constant voltage data writing signal PVI is made of a constant voltage, so that the constant voltage writing signal PVI can be used as a pre-charge voltage. This means, conversely, that the constant voltage writing signal PVI is generated by using a pre-charge voltage generating circuit (not shown). Therefore, an existing pre-charge voltage generating circuit which is generally provided can be used to generate a constant voltage writing signal PVI, so that it is not necessary to separately provide constant voltage writing signal generating means. This makes it possible to avoid increasing cost.

Incidentally, when a nondisplay portion in the partial-screen display mode performs display, the nondisplay portion retains a content of the display until the content is refreshed. Therefore, for example, there is no need for transforming a solid image and the like displayed in the nondisplay portion, so that such an image only needs to be displayed intermittently.

Accordingly, in the driving device 2 of the liquid crystal display device 11 and the driving method of the liquid crystal display device 11 according to the present embodiment, the areas P1 and P3 serving as nondisplay portions in the partial-screen display mode are driven by a smaller sampling frequency than the area P2 serving as a display portion in the partial-screen display mode.

Therefore, it is possible to cause the areas P1 and P3 serving as the nondisplay portions to perform display less frequently, so that power consumption can be reduced.

Further, the liquid crystal display device 11 according to the present embodiment has the aforementioned driving device 2 of the liquid crystal display device 11, so that it is possible to provide a liquid crystal display device 11 which makes it possible to reduce power consumption.

Note that, the present invention is not to be limited to the embodiments but can be varied in many ways within the scope the claims.

For example, the present embodiment describes a case in which a pre-charge voltage generating circuit is provided on a side of a data signal line driving circuit SD, but this is not necessarily for limitation. The present invention can be applied even when the pre-charge voltage generating circuit is provided on an opposite side of the data signal line driving circuit SD through a data signal wire SL.

As described above, the driving device of the display device according to the present invention is arranged so that: the constant voltage data selection means causes the constant voltage data writing signal from the constant voltage data writing signal generation means to be directly sampled as a pre-charge voltage in case of applying the image display data signal to a display portion in the partial-screen display mode so as to cause the display portion to display an image.

Further, the driving method of the display device according to the present invention is arranged so as to include the step of causing the constant voltage data writing signal from the constant voltage data writing signal generation means to be directly sampled as a pre-charge voltage in case of applying the image display data signal to a display portion in the partial-screen display mode so as to cause the display portion to display an image.

That is, since the constant voltage data writing signal according to the present invention is made of a constant voltage, the constant voltage data writing signal can be used as a pre-charge voltage. This means, conversely, that the constant voltage writing signal is generated by using a pre-charge voltage generating circuit. Therefore, an existing pre-charge voltage generating circuit which is generally provided can be used to generate a constant voltage writing signal, so that it is not necessary to separately provide constant voltage writing signal generating means. This makes it possible to avoid increasing cost.

Further, the driving device of the display device according to the present invention is arranged so that the constant voltage data selection means causes the nondisplay portion in the partial-screen display mode to be driven by a smaller sampling frequency than a display portion in the partial-screen display mode.

Further, the driving method of the display device according to the present invention is arranged so as to include the step of causing the nondisplay portion in the partial-screen display mode to be driven by a smaller sampling frequency than a display portion in the partial-screen display mode.

Therefore, since the nondisplay portion is caused to perform display less frequently, it is possible to reduce power consumption.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A driving device for driving a display device provided with a display screen, having a plurality of scanning signal lines and a plurality of data signal lines crossing each other, in which an image display data signal is outputted to a pixel provided at each of crossings through each of the data signal lines in synchronism with a scanning signal outputted from each of the scanning signal lines, said driving device comprising:

a data signal line driving circuit including a shift register which has (i) multiple stages of flip-flops each of which operates in synchronism with a source clock signal and (ii) a level shifter for boosting the source clock signal whose amplitude is smaller than a driving voltage of each of the flip-flops so as to apply the driving voltage to the flip-flop, said data signal line driving circuit causing a sampling circuit to sample the image display data signal based on an output from the shift register so as to output the image display data signal to the data signal line;

mode switching means for switching a full-screen display mode in which a whole of the display screen performs display and a partial-screen display mode in which only a part of the display screen performs time-sharing display from each other;

constant voltage data writing signal generation means for generating a constant voltage data writing signal made of a constant voltage; and constant voltage data selection means for causing a non-display portion, except for that part of the display screen which performs the time-sharing display in the partial-screen display mode, to directly sample the constant voltage data writing signal from the constant voltage data writing signal generation means so as to output the constant voltage data writing signal to the data signal line.

2. The driving device according to claim 1, wherein the constant voltage data selection means causes the constant voltage data writing signal from the constant voltage data writing signal generation means to be directly sampled as a pre-charge voltage in case of applying the image display data signal to a display portion in the partial-screen display mode so as to cause the display portion to display an image.

3. The driving device according to claim 2, wherein a polarity of the constant voltage data writing signal changes in every single horizontal scanning period.

4. The driving device according to claim 2, wherein a polarity of the constant voltage data writing signal changes in every single vertical scanning period.

5. The driving device according to claim 1, wherein a polarity of the constant voltage data writing signal changes in every single horizontal scanning period.

6. The driving device according to claim 1, wherein a polarity of the constant voltage data writing signal changes in every single vertical scanning period.

7. The driving device according to claim 1, wherein the constant voltage data selection means causes the nondisplay portion in the partial-screen display mode to be driven by a smaller sampling frequency than a display portion in the partial-screen display mode.

8. A display device provided with a display screen, having a plurality of scanning signal lines and a plurality of data signal lines crossing each other, in which an image display data signal is outputted to a pixel provided at each of crossings through each of the data signal lines in synchronism with a scanning signal outputted from each of the scanning signal lines, the display device comprising a driving device which includes:

a data signal line driving circuit including a shift register which has (i) multiple stages of flip-flops each of which operates in synchronism with a source clock signal and (ii) a level shifter for boosting the source clock signal whose amplitude is smaller than a driving voltage of each of the flip-flops so as to apply the driving voltage to the flip-flop, said data signal line driving circuit causing a sampling circuit to sample the image display data signal based on an output from the shift register so as to output the image display data signal to the data signal line;

mode switching means for switching a full-screen display mode in which a whole of the display screen performs display and a partial-screen display mode in which only a part of the display screen performs time-sharing display from each other;

constant voltage data writing signal generation means for generating a constant voltage data writing signal made of a constant voltage; and constant voltage data selection means for causing a non-display portion, except for that part of the display screen which performs the time-sharing display in the partial-screen display mode, to directly sample the constant voltage data writing signal from the constant voltage data writing signal generation means so as to output the constant voltage data writing signal to the data signal line.

9. The display device according to claim 8, wherein the constant voltage data selection means of the driving device causes the constant voltage data writing signal from the constant voltage data writing signal generation means to be directly sampled as a pre-charge voltage in case of applying the image display data signal to a display portion in the partial-screen display mode so as to cause the display portion to display an image.

10. A method for driving a display device provided with a display screen, having a plurality of scanning signal lines and a plurality of data signal lines crossing each other, in which an image display data signal is outputted to a pixel provided at each of crossings through each of the data signal lines in synchronism with a scanning signal outputted from each of the scanning signal lines, said display device having a driving device which includes:

a data signal line driving circuit having a shift register which has (i) multiple stages of flip-flops each of which operates in synchronism with a source clock signal and (ii) a level shifter for boosting the source clock signal whose amplitude is smaller than a driving voltage of each of the flip-flops so as to apply the driving voltage to the flip-flop, said data signal line driving circuit causing a sampling circuit to sample the image display data signal based on an output from the shift register so as to output the image display data signal to the data signal line, said method comprising the steps of:

switching a full-screen display mode in which a whole of the display screen performs display and a partial-screen display mode in which only a part of the display screen performs time-sharing display from each other;

generating a constant voltage data writing signal made of a constant voltage; and causing a nondisplay portion, except for that part of the display screen which performs the time-sharing display in the partial-screen display mode, to directly sample the constant voltage data writing signal from the constant voltage data writing signal generation means so as to output the constant voltage data writing signal to the data signal line.

11. The method according to claim 10, comprising the step of causing the constant voltage data writing signal from the constant voltage data writing signal generation means to be directly sampled as a pre-charge voltage in case of applying the image display data signal to a display portion in the partial-screen display mode so as to cause the display portion to display an image.

12. The method according to claim 11, comprising the step of changing a polarity of the constant voltage data writing signal in every single horizontal scanning period.

13. The method according to claim 11, comprising the step of changing a polarity of the constant voltage data writing signal in every single vertical scanning period.

14. The method according to claim 10, comprising the step of changing a polarity of the constant voltage data writing signal in every single horizontal scanning period.

15. The method according to claim 10, comprising the step of changing a polarity of the constant voltage data writing signal in every single vertical scanning period.

16. The method according to claim 10, comprising the step of causing the nondisplay portion in the partial-screen display mode to be driven by a smaller sampling frequency than a display portion in the partial-screen display mode.

* * * * *